US009217943B2

(12) United States Patent
Matsui et al.

(10) Patent No.: US 9,217,943 B2
(45) Date of Patent: Dec. 22, 2015

(54) MAGNETIC TONER

(71) Applicant: CANON KABUSHIKI KAISHA, Tokyo (JP)

(72) Inventors: Takashi Matsui, Mishima (JP); Yusuke Hasegawa, Suntou-gun (JP); Shotaro Nomura, Suntou-gun (JP); Michihisa Magome, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/362,377

(22) PCT Filed: Dec. 26, 2012

(86) PCT No.: PCT/JP2012/084289
§ 371 (c)(1),
(2) Date: Jun. 2, 2014

(87) PCT Pub. No.: WO2013/100185
PCT Pub. Date: Jul. 4, 2013

(65) Prior Publication Data

US 2014/0315125 A1 Oct. 23, 2014

(30) Foreign Application Priority Data

Dec. 27, 2011 (JP) ..... 2011-286062

(51) Int. Cl.
*G03G 9/083* (2006.01)
*G03G 9/087* (2006.01)
*G03G 9/097* (2006.01)

(52) U.S. Cl.
CPC ..... *G03G 9/0837* (2013.01); *G03G 9/083* (2013.01); *G03G 9/0833* (2013.01); *G03G 9/0835* (2013.01); *G03G 9/08708* (2013.01); *G03G 9/08782* (2013.01); *G03G 9/08795* (2013.01); *G03G 9/08797* (2013.01); *G03G 9/09708* (2013.01); *G03G 9/09725* (2013.01)

(58) Field of Classification Search
CPC ..... G03G 9/09725; G03G 9/09708; G03G 9/083; G03G 9/0833; G03G 9/08708; G03G 9/08797; G03G 9/08795
USPC ..... 430/106.1, 106.2, 108.7, 108.6, 109.3
See application file for complete search history.

(56) References Cited

U.S. PATENT DOCUMENTS

| | | | | |
|---|---|---|---|---|
| 5,456,990 | A * | 10/1995 | Takagi et al. | 430/106.1 |
| 6,270,937 | B2 | 8/2001 | Yuasa et al. | |
| 6,432,599 | B1 | 8/2002 | Yuasa et al. | |

FOREIGN PATENT DOCUMENTS

| | | | |
|---|---|---|---|
| JP | 2-167561 | A | 6/1990 |
| JP | 4-145448 | A | 5/1992 |
| JP | 8-328291 | A | 12/1996 |
| JP | 2000-10337 | A | 1/2000 |
| JP | 2001-281923 | A | 10/2001 |
| JP | 2004-21126 | A | 1/2004 |
| JP | 2007-57787 | A | 3/2007 |
| JP | 2007-293043 | A | 11/2007 |
| JP | 2008-15248 | A | 1/2008 |
| JP | 2008-015248 | A * | 1/2008 |
| JP | 2009-229785 | A | 10/2009 |
| JP | 2009-276641 | A | 11/2009 |

OTHER PUBLICATIONS

European Patent Office machiine-assisted English-language translation of Japanese Patent Document JP 2008-015248 A (published Jan. 2008).*
Taiwanese Office Action dated Jan. 20, 2015 in Taiwanese Application No. 101150561.
PCT International Search Report and Written Opinion of the International Searching Authority, International Application No. JP2012/084289, Mailing Date Apr. 2, 2013.
Hasegawa, et al., U.S. Appl. No. 14/364,067, filed Jun. 9, 2014.
Magome, et al., U.S. Appl. No. 14/364,068, filed Jun. 9, 2014.
Hiroko, et al., U.S. Appl. No. 14/364,065, filed Jun. 9, 2014.
Suzumura, et al., U.S. Appl. No. 14/362,380, filed Jun. 2, 2014.
Ohmori, et al., U.S. Appl. No. 14/364,633, filed Jun. 11, 2014.
Sano, et al., U.S. Appl. No.14/364,636, filed Jun. 11, 2014.
Uratani, et al., U.S. Appl. No. 141364,634, filed Jun. 11, 2014.
Nomura, et al., U.S. Appl. No. 14/364,640, filed Jun. 11, 2014.
Tanaka, et al., U.S. Appl. No. 14/364,638, filed Jun. 11, 2014.

* cited by examiner

*Primary Examiner* — Janis L Dote
(74) *Attorney, Agent, or Firm* — Fitzpatrick, Cella, Harper and Scinto

(57) ABSTRACT

The magnetic toner contains magnetic toner particles containing a binder resin and a magnetic body, and inorganic fine particles present on the surface of the magnetic toner particles. The coverage ratio of the magnetic toner particle surface by the inorganic fine particles resides in a prescribed range for this magnetic toner; the binder resin is a styrene resin; the weight-average molecular weight and radius of gyration of the magnetic toner reside in a prescribed relationship; and the viscosity of the magnetic toner at 110° C. resides in a prescribed range.

4 Claims, 7 Drawing Sheets

MAGNETIC TONER

TECHNICAL FIELD

The present invention relates to a magnetic toner for use in, for example, electrophotographic methods, electrostatic recording methods, and magnetic recording methods.

BACKGROUND ART

Printers and copiers have in recent years been transitioning from analog to digital, and while there is strong demand for an excellent latent image reproducibility and high resolution, there is at the same time strong demand for greater energy savings and higher stability.

Lowering the power consumption in the fixing step of a copier or printer is crucial when greater energy savings are considered here.

The implementation of film fixing to achieve additional reductions in the fixation temperature is an effective method for reducing the power consumption. Film fixing readily supports a reduction in power consumption because it provides an excellent thermal conductivity through the use of a film.

An issue associated with reducing the fixation temperature with film fixing is that the releasability between the toner and film during fixing is inadequate and the toner cannot be fixed to the media, e.g., paper, and the occurrence of development in which a portion of the toner is taken off by the film, so-called "cold offset", has frequently been observed.

There have been attempts at improving cold offset by focusing on the fixing unit; for example, improvements have been pursued based on the film material and based on methods that control the pressure, pressure distribution, and fixation temperature during fixing.

There have, on the other hand, also been toner-oriented attempts to improve cold offset.

Examples in this regard include lowering the melting point of the release agent and/or adding large amounts of release agent and lowering the molecular weight of the binder resin and/or lowering the glass-transition temperature of the binder resin. These methods do tend to improve cold offset, but additional improvements are required. In addition, there is a tendency with these toners for the developing performance to also be diminished, and in particular a substantial reduction in image stability is quite prone to occur during long-term use.

With regard to improving the toner in order to enhance the stability during long-term use, there have been efforts to reduce the changes in durability by, for example, engineering the method of attaching external additives to the toner particle and engineering the type of external additive.

In Patent Document 1, a toner is disclosed for which the toner particles are produced by the emulsion aggregation of a styrene resin, paraffin wax, and so forth; the external addition method is engineered; and the ratio between the saturation water content HL under low-temperature, low-humidity conditions and the saturation water content HH under high-temperature, high-humidity conditions is brought into a prescribed range.

Controlling the water content in this manner did in fact provide a certain improvement in the transferability and image density reproducibility; however, no reference was made to cold offset and this has been inadequate for obtaining the effects of the present invention.

In Patent Document 2, a stabilization of the developing • transfer steps is devised through control of the total coverage ratio of the toner base particle by an external additive, and in fact a certain effect is obtained for a prescribed toner base particle by controlling a calculated theoretical coverage ratio. However, the actual state of attachment of an external additive is quite different from the value calculated under the assumption that the toner is spherical, and the stability during long-term use, which is the problem identified above, does not correlate with this theoretical coverage ratio and improvement has thus been required.

CITATION LIST

Patent Literature

[PTL 1] Japanese Patent Application Publication No. 2009-229785

[PTL 2] Japanese Patent Application Publication No. 2007-293043

SUMMARY OF INVENTION

Technical Problems

The present invention is to provide a magnetic toner that can solve the problems identified above.

Specially, an object of the present invention is to provide a magnetic toner that yields a stable image density during long-time use and that can prevent the occurrence of cold offset.

Solution to Problem

The present inventors discovered that the problems can be solved by specifying the relationship between the coverage ratio of the magnetic toner particle surface by the inorganic fine particles and the coverage ratio by inorganic fine particles that are fixed to the magnetic toner particle surface and by specifying molecular weight, degree of branching and viscosity at 110° C. of the magnetic toner. The present invention was achieved based on this discovery. Thus, the present invention is described as follows:

a magnetic toner comprising: magnetic toner particles comprising a binder resin and a magnetic body; and inorganic fine particles present on the surface of the magnetic toner particles, wherein;

the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of from at least 0.50 to not more than 0.85; and the binder resin is a styrene resin;

for a weight-average molecular weight (Mw) and an radius of gyration (Rw) measured on the ortho-dichlorobenzene-soluble matter from the magnetic toner in use of size exclusion chromatograph with a multiangle laser light scattering (SEC-MALLS), the weight-average molecular weight (Mw) is from at least 5000 to not more than 20000 and the ratio

[Rw/Mw] of this radius of gyration (Rw) to the weight-average molecular weight (Mw) is from at least $3.0\times10^{-3}$ to not more than $6.5\times10^{-3}$; and the viscosity of the magnetic toner at 110° C. measured by a flow tester/temperature ramp-up method is from at least 5000 Pa·s to not more than 25000 Pa·s.

Advantageous Effects of Invention

The present invention can provide a magnetic toner that yields a stable image density during long-time use and can prevent the occurrence of cold offset.

DESCRIPTION OF EMBODIMENTS

Figure 1:
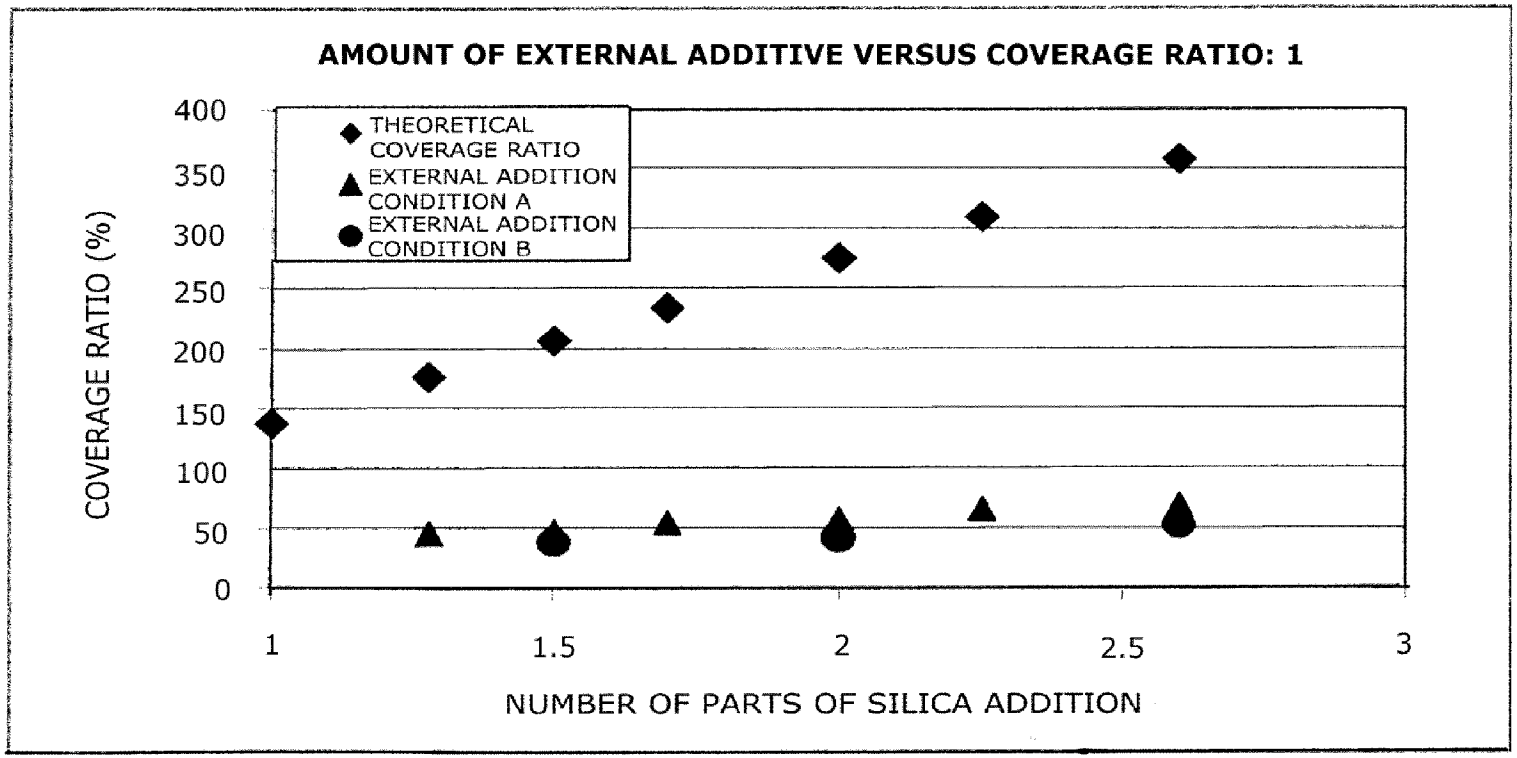
FIG. 1 is a diagram that shows an example of the relationship between the number of parts of silica addition and the coverage ratio.

The present invention is described in detail below.

The present invention relates to a magnetic toner (hereinafter referred to also as "toner") comprising: magnetic toner particles comprising a binder resin and a magnetic body; and inorganic fine particles present on the surface of the magnetic toner particles, wherein the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particle surface, the magnetic toner has a coverage ratio A of at least 45.0% and not more than 70.0% and a ratio [coverage ratio B/coverage ratio A] of the coverage ratio B to the coverage ratio A of from at least 0.50 to not more than 0.85; and the binder resin is a styrene resin;

for a weight-average molecular weight (Mw) and an radius of gyration (Rw) measured on the ortho-dichlorobenzene-soluble matter from the magnetic toner using size exclusion chromatograph with a multiangle laser light scattering (SEC-MALLS), the weight-average molecular weight (Mw) is from at least 5000 to not more than 20000 and the ratio [Rw/Mw] of this radius of gyration (Rw) to the weight-average molecular weight (Mw) is from at least $3.0\times10^{-3}$ to not more than $6.5\times10^{-3}$; and the viscosity of the magnetic toner at 110° C. measured by a flow tester/temperature ramp-up method is from at least 5000 Pa·s to not more than 25000 Pa·s.

According to investigations by the present inventors, the use of the above-described magnetic toner can provide a stable image density during long-term use and can suppress the appearance of cold offset.

The causes of the appearance of cold offset will now be considered.

When the behavior during fixing is considered, [1] unfixed toner is first loaded on the media, e.g., paper. [2] Then, when the unfixed toner is passed through the fixing unit, the toner is melted • deformed and the release agent also outmigrates to the toner surface and as a result the toner particles bond to each other and are anchored to the paper, i.e., the media, and the toner is fixed. During the passage of the toner through the fixing nip section that is formed by the fixing film and a pressure roller, the driving forces by which the toner is fixed are provided by the application of heat to the toner across the fixing film from the heat source in the fixing unit and by the application of pressure due to the pressure from, for example, the pressure roller during passage through the fixing nip section. [3] After passage through the fixing nip, the toner is released from the fixing film and is fixed to the paper.

With regard to the cause of cold offset during this, cold offset appears when, for any of the factors described below, the toner that has traversed the fixing nip is unable to release from the fixing film and becomes attached to the fixing film.

The factors that result in the appearance of cold offset will now be considered. The following can be considered: [1] the case in which melting of the toner in the fixing nip region is insufficient, for example, only toner on the heat source side (fixing film side) undergoes melting, while toner on the side distant from the heat source (media side) cannot melt, resulting in inadequate adherence to the media and attachment to the fixing film; [2] the case in which the toner undergoes adequate melting in the fixing nip region, but outmigration of the release agent to the toner surface is insufficient, resulting in inadequate releasability from the fixing film and attachment to the fixing film.

Using conventional methods, the present inventors therefore prepared magnetic toners in which melting • deformation • release agent outmigration were promoted. Thus, a magnetic toner A was prepared using silica as an external additive for magnetic toner particles in which a large amount of a release agent had been added to a binder resin that had a low molecular weight and a low glass-transition temperature. A magnetic toner B was also prepared in which the amount of silica addition was reduced in order to further improve the fixing performance.

According to the results, magnetic toner A had a better low-temperature fixability and also an improved cold offset property in comparison to conventional magnetic toners. In addition, magnetic toner B, while having an even better low-temperature fixability than magnetic toner A, gave the same result as magnetic toner A with regard to the cold offset property.

While an improved cold offset property was observed with both magnetic toners, the results were inadequate relative to the cold offset property that the present inventors were seeking. In addition, with regard to the image density during long-term use, which was checked in conjunction with the low-temperature fixability, a much poorer result was obtained than for conventional magnetic toners.

When these results of the evaluation of cold offset property were considered, the cold offset property was not improved even for magnetic toner B, which had been improved to make possible an even greater promotion of melting • deformation • release agent outmigration than with magnetic toner A. Thus, the conclusion was drawn that some factor other then melting • deformation • release agent outmigration is necessary in order to improve the cold offset property of a magnetic toner. In addition, improvement in the stabilization of the image density during long-term use was also necessary.

The present inventors therefore carried out focused investigations in order to obtain additional improvements in the cold offset and in order to achieve stabilization of the image density during long-term use. It was discovered as a result that the problems identified above could be solved by specifying the relationship between the coverage ratio by the inorganic fine particles that are fixed to the magnetic toner particle surface and the coverage ratio of the magnetic toner particle surface by the inorganic fine particles and by specifying the molecular weight, degree of branching, and viscosity at 110° C. of the magnetic toner.

First, a summary for the magnetic toner of the present invention includes improving the sharp melt property by bringing about a reduction in the melt viscosity during melt for the magnetic toner of the present invention. The means here for achieving the viscosity reduction during melt does not use a conventional technique such as lowering the molecular weight and/or lowering the glass-transition temperature of the binder resin in the magnetic toner; rather, the reduction in the melt viscosity is achieved by controlling the degree of branching for the magnetic toner to a linear chain type.

In addition, the coverage ratio by the inorganic fine particles that are fixed to the magnetic toner particle surface is optimized for the magnetic toner of the present invention. With such a magnetic toner, the heat is readily transferred to the magnetic toner; melting • deformation • release agent outmigration are facilitated for the magnetic toner; and an unprecedented improvement is achieved for the releasability from the fixing film.

The analysis of the present inventors is given below in sequence according to the previously described behavior during fixing.

[1] First, with regard to the state of the unfixed image on the media, e.g., paper, in the present invention, it is thought that the surface of the unfixed image (the side distant from the media; the side that contacts the fixing film) is smooth and loading on the media, e.g., paper, occurs in a state in which the magnetic toner approximates closest packing.

When this occurs, the optimization of the coverage ratio by the inorganic fine particles fixed to the magnetic toner particle surface in the magnetic toner results in the formation, for example, of a shell layer by the inorganic fine particles, and as a consequence the van der Waals force is readily reduced and the attachment force between the magnetic toners is diminished. In addition, a bearing effect due to the inorganic fine particles is also believed to exist. Due to these effects, aggregation of the magnetic toner is inhibited and the attachment force with members and the attachment force between the magnetic toners are also readily diminished.

As a consequence, the magnetic toner developed to the image-bearing member undergoes relaxation without aggregation and as a result a state approximating closest packing is provided. In addition, at the point at which the magnetic toner is transferred from the image-bearing member onto the media, e.g., paper, it is thought that, since the attachment force to members has been reduced, the transferability is improved and the surface of the unfixed image is made smooth.

[2] Then, when the unfixed magnetic toner is passed through the fixing nip, the heat is transferred uniformly and efficiently to the magnetic toner since, as described in [1], the surface of the unfixed image is smooth and resides in a state approximating closest packing. In addition, since in the present invention the reduction in the melt viscosity during melt is engineered by controlling the degree of branching in the magnetic toner to a linear chain type, the sharp melt property is substantially improved over that for a magnetic toner that achieves viscosity reduction by techniques such as using a branched-type binder resin and lowering the molecular weight. It is thought that the melting • deformation • release agent outmigration of the magnetic toner is promoted as a result.

With regard to the reason for this, the melting of the binder resin is believed to be synonymous with the molecular chains, which are entangled in a coiled configuration in the glassy state, undergoing heat-induced molecular motion and the molecular chains then being able to engage in free motion. As a consequence, the sharp melt property is thought to be more readily influenced by the degree of branching than by the molecular weight.

[3] With regard to the necessity for the magnetic toner to release from the fixing film after passage through the fixing nip, it is hypothesized that the state of existence of the inorganic fine particles at the fixed image surface during separation from the fixing film is different for the magnetic toner of the present invention from that for conventional magnetic toners.

Thus, it is hypothesized that—in contrast to conventional magnetic toners, which reside in a state in which release agent and binder resin are exposed at the fixed image surface—the magnetic toner of the present invention resides in a state in which the release agent and the high-coverage, fixed inorganic fine particles are present at the fixed image surface.

This is thought to result in a substantial enhancement of the releasability from the fixing film and an improvement in the cold offset property. The reason for this improvement in the cold offset property is thought to be a synergetic effect between the high sharp melt property of the magnetic toner of the present invention and the high-coverage, fixed inorganic fine particles.

To summarize the preceding, the control exercised in the present invention on the coverage ratio by the fixed inorganic fine particles is thought to provide a smooth surface for the unfixed image and to result in loading of the unfixed magnetic toner on the media, e.g., paper, in a state approximating closest packing. A high sharp melt property is generated because this unfixed image can uniformly and efficiently receive heat from the fixing unit and because a low melt viscosity during melt is obtained by controlling the molecular weight and degree of branching of the magnetic toner. An instantaneous melting • deformation • release agent outmigration is made possible for the magnetic toner of the present invention as a result. Furthermore, at the time of release by the magnetic toner from the fixing film, the high sharp melt property exhibited by the magnetic toner of the present invention facilitates maintenance of the state of the magnetic toner surface. Due to this, a state is provided in which the high-coverage, fixed inorganic fine particles and the release agent are present, resulting in a substantial enhancement of the releasability from the fixing film. It is thought that cold offset is improved due to this synergetic effect.

It was further demonstrated that the stability during long-term use could also be maintained with the magnetic toner of the present invention. The present inventors believe the reasons for this are as follows.

A relationship is specified for the magnetic toner of the present invention between the coverage ratio by inorganic fine particles fixed to the magnetic toner particle surface (coverage ratio B) and the coverage ratio of the magnetic toner particle surface by the inorganic fine particles (coverage ratio A). As a consequence of this, the previously described aggregative behavior between the magnetic toners is reduced and the attachment force between the magnetic toner and members is diminished, which as a consequence during tribocharging in the developing device inhibits the application of excessive stress and inhibits the deterioration of the magnetic toner.

In addition, because the state of being fixed to the magnetic toner particle surface is made more extensive than in the conventional state of coverage by inorganic fine particles, the burying of the inorganic fine particles into the magnetic toner particle during long-term use is inhibited. Moreover, changes in the state of existence of the inorganic fine particles during long-term use can be lessened by providing the state of being fixed to the magnetic toner particle surface.

Furthermore, a lowering of the melt viscosity during melt has been engineered for the magnetic toner of the present invention by controlling the molecular weight and degree of branching, but the molecular weight is larger than for conventional toners that achieve a lowering of the viscosity by lowering the molecular weight and/or lowering the glass-transition temperature. The degree of branching for the magnetic toner is linear chain type, but due to the high molecular weight the strength is increased—in comparison to a magnetic toner of the type having a reduced molecular weight—in the region less than or equal to the glass-transition temperature of the magnetic toner. Due to this, toner deterioration is suppressed even during long-term use and the image stability is thus improved.

It is hypothesized that toner deterioration during long-term use is suppressed and image stabilization is thereby achieved by specifying this relationship between the coverage ratio due to inorganic fine particles fixed to the magnetic toner particle surface and the coverage ratio of the inorganic toner particle surface by the inorganic fine particles and by specifying the molecular weight and degree of branching of the magnetic toner.

The magnetic toner of the present invention is specifically described herebelow.

Moreover, when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, it is critical for the magnetic toner of the present invention that the coverage ratio A be at least 45.0% and not more than 70.0% and that the ratio [coverage ratio B/coverage ratio A, also referred to below simply as B/A] of the coverage ratio B to the coverage ratio A be at least 0.50 and not more than 0.85. The coverage ratio A is preferably at least 45.0% and not more than 65.0% and [B/A] is preferably at least 0.55 and not more than 0.80.

Because the coverage ratio A is high at at least 45.0% in the magnetic toner of the present invention, the van der Waals force between the magnetic toner and members is low and the attachment force between the magnetic toners and with members is readily lessened and an improvement in image stabilization during long-term use and in the cold offset property is thereby made possible.

On the other hand, the inorganic fine particles must be added in large amounts to bring the coverage ratio A to greater than 70.0%. Even if an external addition method could be devised for this, thermal conduction during fixing would be degraded by the released inorganic fine particles and the releasability from the fixing film would be degraded and the cold offset property would worsen as a result. Here, the coverage ratio A (%), coverage ratio B (%) and B/A can be obtained following methods.

The coverage ratio A is a coverage ratio that also includes the easily-releasable inorganic fine particles, while the coverage ratio B is the coverage ratio due to inorganic fine particles that are fixed to the magnetic toner particle surface and are not released in the release process described below. It is thought that the inorganic fine particles represented by the coverage ratio B are fixed in a semi-embedded state in the magnetic toner particle surface and therefore do not undergo displacement even when the magnetic toner is subjected to shear on the developing sleeve or on the electrostatic latent image-bearing member.

The inorganic fine particles represented by the coverage ratio A, on the other hand, include the fixed inorganic fine particles described above as well as inorganic fine particles that are present in the upper layer and have a relatively high degree of freedom. The presence of inorganic finer particles present among magnetic toners and between the magnetic toner and each component influences reduction in aggregability and reduction in adhesiveness. In order to address this reduction, an increase in the coverage ratio A appears to be important.

As described above, the magnetic toner of the present invention exhibits an excellent releasability from members. This point will be considered in detail in the following from the perspective of the van der Waals force and the electrostatic force.

First, the van der Waals force (F) produced between a flat plate and a particle is represented by the following equation.

$$F = H \times D / (12Z^2)$$

Here, H is Hamaker's constant, D is the diameter of the particle, and Z is the distance between the particle and the flat plate.

With respect to Z, it is generally held that an attractive force operates at large distances and a repulsive force operates at very small distances, and Z is treated as a constant since it is unrelated to the state of the magnetic toner particle surface.

According to the preceding equation, the van der Waals force (F) is proportional to the diameter of the particle in contact with the flat plate. When this is applied to the magnetic toner surface, the van der Waals force (F) is smaller for an inorganic fine particle, with its smaller particle size, in contact with the flat plate than for a magnetic toner particle in contact with the flat plate. That is, the van der Waals force is smaller for the case of contact through the intermediary of the fine inorganic particles provided as an external additive than for the case of direct contact between the magnetic toner particle and each component (developing blade, electrostatic latent image-bearing member, and fixing film).

Furthermore, the electrostatic force can be regarded as a reflection force. It is known that a reflection force is directly proportional to the square of the particle charge (q) and is inversely proportional to the square of the distance.

In the case of the charging of a magnetic toner, it is the surface of the magnetic toner particle and not the inorganic fine particles that bear the charge. Due to this, the reflection force declines as the distance between the surface of the magnetic toner particle and the flat plate (here, the fixing film) grows larger.

That is, when, in the case of the magnetic toner surface, the magnetic toner particle comes into contact with the flat plate through the intermediary of the inorganic fine particles, a distance is set up between the flat plate and the surface of the magnetic toner particle and the reflection force is lowered as a result.

As described in the preceding, the van der Waals force and reflection force produced between the magnetic toner and the fixing film are reduced by having inorganic fine particles be present at the magnetic toner particle surface and having the magnetic toner come into contact with the fixing film with the inorganic fine particles interposed therebetween. That is, the attachment force between the magnetic toner and the fixing film is reduced.

Whether the magnetic toner particle directly contacts the fixing film or is in contact therewith through the intermediary of the inorganic fine particles, depends on the amount of inorganic fine particles coating the magnetic toner particle surface, i.e., on the coverage ratio by the inorganic fine particles.

It is thought that the opportunity for direct contact between the magnetic toner particles and the fixing film is diminished at a high coverage ratio by the inorganic fine particles, which makes it more difficult for the magnetic toner to stick to the fixing film. On the other hand, the magnetic toner readily sticks to the fixing film at a low coverage ratio by the inorganic fine particles and property of release from the fixing film is reduced.

On the other hand, that B/A is at least 0.50 to not more than 0.85 means that inorganic fine particles fixed to the magnetic toner surface are present to a certain degree and that in addition inorganic fine particles in a readily releasable state (a state that enables behavior separated from the magnetic toner particle) are also present in a favorable amount. It is thought that a bearing-like effect is generated presumably by the releasable inorganic fine particles sliding against the fixed inorganic fine particles and that the aggregative forces between the magnetic toners are then substantially reduced. Due to this, as noted above the surface of the unfixed image is made smooth and a state can be set up that approximates closest packing and the heat from the fixing unit can then be uniformly and efficiently applied to the magnetic toner. In addition, excess stress on the magnetic toner is eliminated by the bearing effect and as a consequence the image stability during long-term use is substantially improved.

According to the results of investigations by the present inventors, it was found that this bearing effect and the above-described attachment force-reducing effect are maximally obtained when both the fixed inorganic fine particles and the easily releasable inorganic fine particles are relatively small inorganic fine particles having a primary particle number-average particle diameter (D1) of approximately not more than 50 nm. Accordingly, the coverage ratio A and the coverage ratio B were calculated focusing on the inorganic fine particles having a primary particle number-average particle diameter (D1) of not more than 50 nm.

In addition, the coefficient of variation on the coverage ratio A is preferably not more than 10.0% in the present invention and more preferably is not more than 8.0%. Specifying a coefficient of variation of not more than 10.0% means that the coverage ratio A is very uniform between magnetic toner particles and within a magnetic toner particle.

The coefficient of variation on the coverage ratio A is preferably not more than 10.0% because this facilitates the generation of releasability from the fixing film even more by causing the fixed inorganic fine particles to be even more uniformly present at the fixed image surface after passage through the fixing nip as described above.

When the coefficient of variation on the coverage ratio A exceeds 10.0%, the state of coverage of the magnetic toner surface is nonuniform, which impairs the ability to lower the aggregative forces between the toners.

There are no particular limitations on the technique for bringing the coefficient of variation on the coverage ratio A to 10.0% or below, but the use is preferred of the external addition apparatus and technique described below, which are capable of bringing about a high degree of spreading of the metal oxide fine particles, e.g., silica fine particles, over the magnetic toner particle surfaces.

With regard to the coverage ratio by the inorganic fine particles, a theoretical coverage ratio can be calculated—making the assumption that the inorganic fine particles and the magnetic toner have a spherical shape—using the equation described, for example, in Patent Document 2. However, there are also many instances in which the inorganic fine particles and/or the magnetic toner do not have a spherical shape, and in addition the inorganic fine particles may also be present in an aggregated state at the toner particle surface. As a consequence, the theoretical coverage ratio derived using the indicated technique does not pertain to the present invention.

The present inventors therefore carried out observation of the magnetic toner surface with the scanning electron microscope (SEM) and determined the coverage ratio for the actual coverage of the magnetic toner particle surface by the inorganic fine particles.

Figure 2:
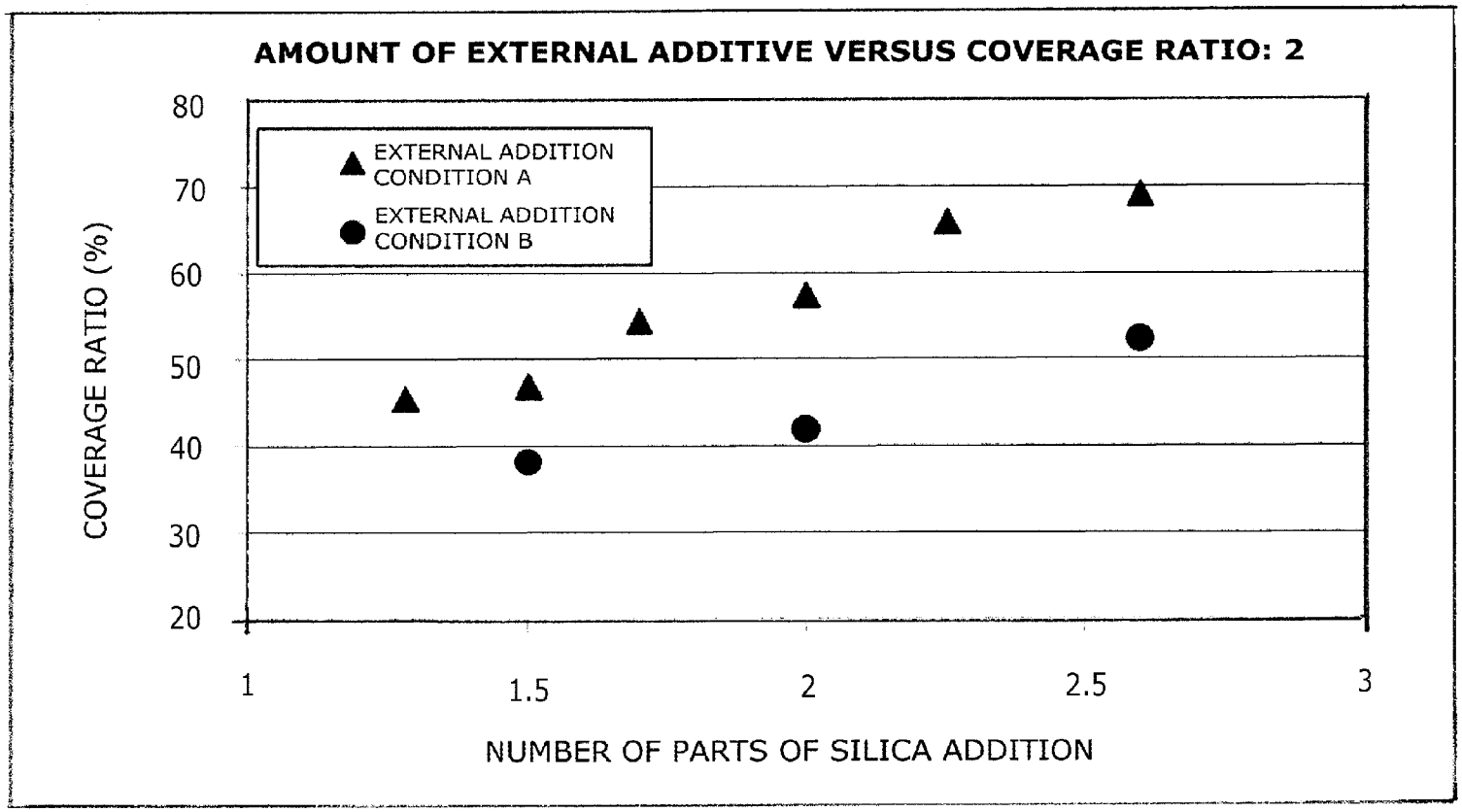
FIG. 2 is a diagram that shows an example of the relationship between the number of parts of silica addition and the coverage ratio.

As one example, the theoretical coverage ratio and the actual coverage ratio were determined for mixtures prepared by adding different amounts of silica fine particles (number of parts of silica addition) to 100 mass parts of magnetic toner particles (magnetic body content=43.5 mass %) provided by a pulverization method and having a volume-average particle diameter (Dv) of 8.0 μm (refer to FIGS. 1 and 2). Silica fine particles with a volume-average particle diameter (Dv) of 15 nm were used for the silica fine particles.

For the calculation of the theoretical coverage ratio, 2.2 $g/cm^3$ was used for the true specific gravity of the silica fine particles; 1.65 $g/cm^3$ was used for the true specific gravity of the magnetic toner; and monodisperse particles with a particle diameter of 15 nm and 8.0 μm were assumed for, respectively, the silica fine particles and the magnetic toner particles.

As shown in FIG. 1, the theoretical coverage ratio exceeds 100% as the amount of addition of the silica fine particles is increased. On the other hand, the actual coverage ratio does vary with the amount of addition of the silica fine particles, but does not exceed 100%. This is due to silica fine particles being present to some degree as aggregates on the magnetic toner surface or is due to a large effect from the silica fine particles not being spherical.

Moreover, according to investigations by the present inventors, it was found that, even at the same amount of addition by the silica fine particles, the coverage ratio varied with the external addition technique. That is, it is not possible to determine the coverage ratio uniquely from the amount of addition of the silica fine particles (refer to FIG. 2). Here, external addition condition A refers to mixing at 1.0 W/g for a processing time of 5 minutes using the apparatus in FIG. 4. External addition condition B refers to mixing at 4000 rpm for a processing time of 2 minutes using an FM10C HENSCHEL mixer (from Mitsui Miike Chemical Engineering Machinery Co., Ltd.).

For the reasons provided in the preceding, the present inventors used the inorganic fine particle coverage ratio obtained by SEM observation of the magnetic toner surface.

In addition, as has been noted above, it is thought that the attachment force to a member can be reduced by raising the coverage ratio by the inorganic fine particles. Tests were therefore carried out on the attachment force with a member and the coverage ratio by the inorganic fine particles.

The relationship between the coverage ratio for the magnetic toner and the attachment force with a member was indirectly inferred by measuring the static friction coefficient between an aluminum substrate and spherical polystyrene particles having different coverage ratios by silica fine particles.

Specifically, the relationship between the coverage ratio and the static friction coefficient was determined using spherical polystyrene particles (weight-average particle diameter (D4)=7.5 μm) that had different coverage ratios (coverage ratio determined by SEM observation) by silica fine particles.

Figure 7:
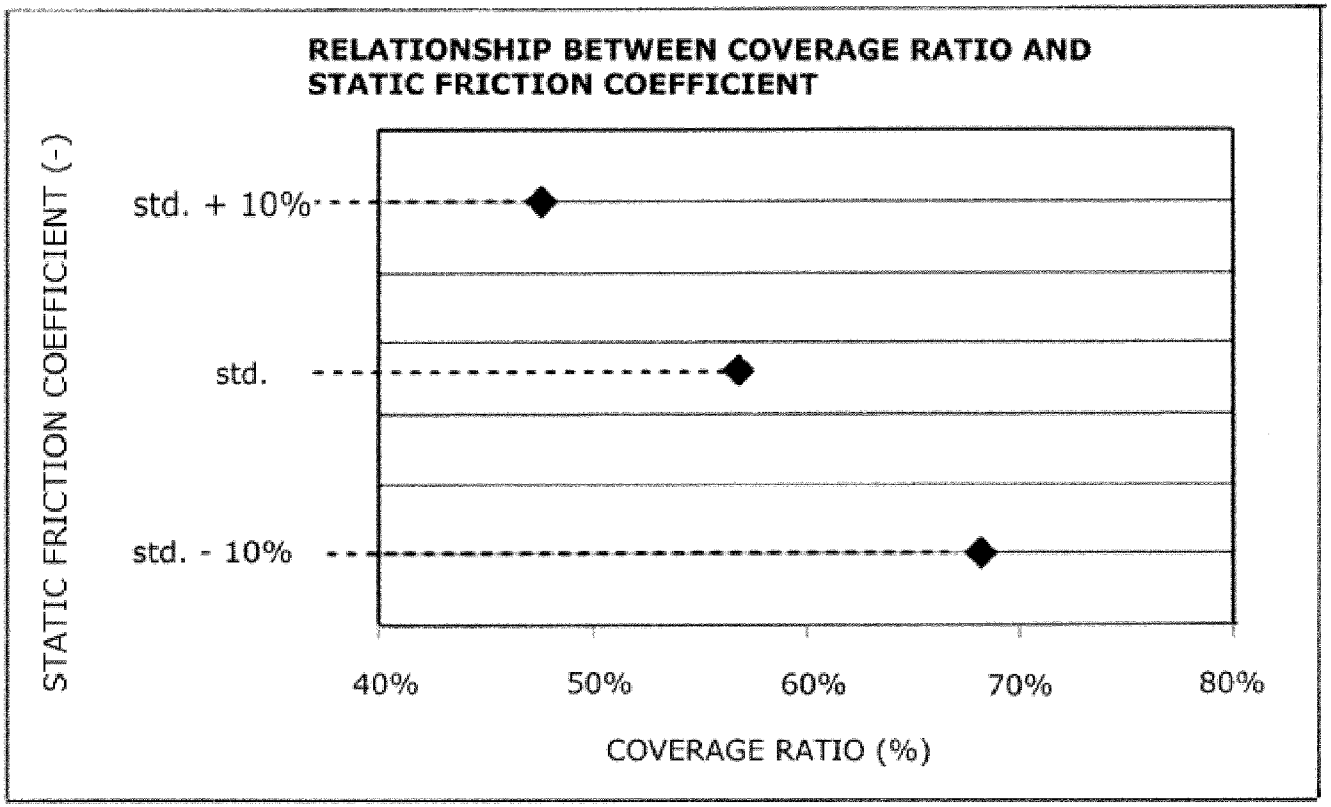
FIG. 7 is a diagram that shows an example of the relationship between the coverage ratio and the static friction coefficient.

More specifically, spherical polystyrene particles to which silica fine particles had been added were pressed onto an aluminum substrate. The substrate was moved to the left and right while changing the pressing pressure, and the static friction coefficient was calculated from the resulting stress. This was performed for the spherical polystyrene particles at each different coverage ratio, and the obtained relationship between the coverage ratio and the static friction coefficient is shown in FIG. 7.

The static coefficient of fraction determined by the preceding technique is thought to correlate with the sum of the van der Waals and reflection forces acting between the spherical polystyrene particles and the substrate. According to FIG. 7, a trend appears in which the static friction coefficient declines as the coverage ratio by the silica fine particles increases. That is, it is inferred that a magnetic toner having a high coverage rate by inorganic fine particles also has a low attachment force for a member.

The binder resin for the magnetic toner of the present invention is a styrene resin.

The use of a styrene resin for the binder resin makes it possible to adjust the ratio [Rw/Mw] between the radius of gyration (Rw) and the weight-average molecular weight (Mw) measured using size exclusion chromatograph with a multiangle laser light scattering (SEC-MALLS)—which is a characteristic feature of the magnetic toner of the present invention and an index of the degree of branching—into the desired range.

The styrene resin can be specifically exemplified by polystyrene and by styrene copolymers such as styrene-propylene copolymers, styrene-vinyltoluene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-octyl methacrylate copolymers, styrene-butadiene copolymers, styrene-isoprene copolymers, styrene-maleic acid copolymers, and styrene-maleate ester copolymers. A single one of these may be used or a plurality may be used in combination.

Styrene-butyl acrylate copolymers and styrene-butyl methacrylate copolymers are particularly preferred among the preceding because they support facile adjustment of the degree of branching and resin viscosity and as a consequence facilitate the balanced coexistence of the developing characteristics and cold offset property.

In addition, while the binder resin used in the magnetic toner of the present invention is a styrene resin, the following resins may be used in combination therewith to the extent that the effects of the present invention are not impaired.

For example, a polymethyl methacrylate, polybutyl methacrylate, polyvinyl acetate, polyethylene, polypropylene, polyvinyl butyral, silicone resin, polyester resin, polyamide resin, epoxy resin, or polyacrylic acid resin can be used, and a single one of these may be used or a combination of a plurality thereof may be used.

The monomer for producing this styrene resin can be exemplified by the following:

styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylate esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and derivatives of acrylic acid and methacrylic acid, such as acrylonitrile, methacrylonitrile, and acrylamide.

Additional examples are unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; the half esters of unsaturated dibasic acids, such as the methyl half ester of maleic acid, ethyl half ester of maleic acid, butyl half ester of maleic acid, methyl half ester of citraconic acid, ethyl half ester of citraconic acid, butyl half ester of citraconic acid, methyl half ester of itaconic acid, methyl half ester of alkenylsuccinic acid, methyl half ester of fumaric acid, and methyl half ester of mesaconic acid; unsaturated dibasic acid esters such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride, as well as the anhydrides of lower fatty acids with α,β-unsaturated acids; and monomers that contain the carboxyl group, such as alkenylmalonic acid, alkenylglutaric acid, and alkenyladipic acid and their acid anhydrides and monoesters.

Additional examples are acrylate esters and methacrylate esters, such as 2-hydroxyethyl acrylate, 2-hydroxyethyl methacrylate, and 2-hydroxypropyl methacrylate, and monomers that contain the hydroxy group, such as 4-(1-hydroxy-1-methylbutyl)styrene and 4-(1-hydroxy-1-methylhexyl)styrene.

The styrene resin used in the binder resin in the magnetic toner of the present invention may have a crosslinked structure as provided by crosslinking with a crosslinking agent that contains two or more vinyl groups. The crosslinking agent used here can be exemplified by the following:

aromatic divinyl compounds such as divinylbenzene and divinylnaphthalene;

diacrylate compounds in which linkage is effected by an alkyl chain, such as ethylene glycol diacrylate, 1,3-butylene glycol diacrylate, 1,4-butanediol diacrylate, 1,5-pentanediol acrylate, 1,6-hexanediol diacrylate, neopentyl glycol diacrylate, and compounds provided by replacing the acrylate in the preceding compounds with methacrylate;

diacrylate compounds in which linkage is effected by an ether linkage-containing alkyl chain, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds provided by replacing the acrylate in the preceding compounds with methacrylate;

diacrylate compounds in which linkage is effected by a chain containing an aromatic group and an ether linkage, such as polyoxyethylene(2)-2,2-bis(4-hydroxyphenyl)propane diacrylate, polyoxyethylene(4)-2,2-bis(4-hydroxyphenyl) propane diacrylate, and compounds provided by replacing the acrylate in the preceding compounds with methacrylate;

polyester-type diacrylate compounds, for example, MANDA (product name, Nippon Kayaku Co., Ltd.);

multifunctional crosslinking agents such as pentaerythritol triacrylate, trimethylolethane triacrylate, trimethylolpropane triacrylate, tetramethylolmethane tetraacrylate, oligoester acrylate, and compounds provided by replacing the acrylate in the preceding compounds with methacrylate; as well as triallyl cyanurate and triallyl trimellitate.

The crosslinking agent is used, expressed per 100 mass parts of the other monomer component, preferably at from 0.01 to 10 mass parts and more preferably at from 0.03 to 5 mass parts.

Among these crosslinking monomers, aromatic divinyl compounds (particularly divinylbenzene) and diacrylate compounds in which linkage is effected by a chain containing an aromatic group and an ether linkage are crosslinking monomers preferred for use in the binder resin from the standpoint of the fixing performance and offset resistance.

The polymerization initiator used in the production of the styrene resin under consideration can be exemplified by 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl 2,2'-azobisisobutyrate, 1,1'-azobis(1-cyclohexanecarbonitrile), 2-(carbamoylazo)isobutyronitrile, 2,2'-azobis(2,4,4-trimethylpentane), 2-phenylazo-2,4-dimethyl-4-methoxyvaleronitrile, 2,2-azobis(2-methylpropane), ketone peroxides (e.g., methyl ethyl ketone peroxide, acetylacetone peroxide, and cyclohexanone peroxide), 2,2-bis(t-butylperoxy)butane, t-butyl hydroperoxide, cumene hydroperoxide, 1,1,3,3-tetramethylbutyl hydroperoxide, di-t-butyl peroxide, t-butyl cumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxy isopropyl carbonate, di-t-butyl peroxyisophthalate, t-butylperoxy allyl carbonate, t-amyl peroxy-2-ethylhexanoate, di-t-butyl peroxyhexahydroterephthalate, and di-t-butyl peroxyazelate.

For a weight-average molecular weight (Mw) and an radius of gyration (Rw) measured on the ortho-dichlorobenzene-soluble matter from the magnetic toner of the present invention using size exclusion chromatograph with a multiangle laser light scattering (SEC-MALLS), the weight-average molecular weight (Mw) is from at least 5000 to not more than 20000 and the ratio [Rw/Mw] of the radius of gyration (Rw) to the weight-average molecular weight (Mw) is from at least $3.0\times10^{-2}$ to not more than $6.5\times10^{22}$. The weight-average molecular weight (Mw) is preferably from at least 5000 to not more than 15000, while the ratio [Rw/Mw] of the radius of gyration (Rw) to the weight-average molecular weight (Mw) is preferably from at least $5.0\times10^{-2}$ to not more than $6.5\times10^{-3}$. The unit for the radius of gyration Rw is "nm".

Here, the mean square radius ($Rg^2$) is a value that generally represents the extension per molecule, and the value [Rw/Mw] given by dividing the radius of gyration Rw (the square root of the mean square radius ($Rw=(Rg^2)^{1/2}$)) by the weight-average molecular weight (Mw) is taken to represent the degree of branching per molecule. Accordingly, it is thought that the smaller this [Rw/Mw], the smaller the extension per the molecular weight and as a consequence the larger the degree of branching in the molecule; conversely, the larger the [Rw/Mw], the larger the extension per the molecular weight and as a consequence a straight-chain molecule is indicated.

The mean square radius and weight-average molecular weight determined by SEC-MALLS will now be described. The molecular weight distribution measured by SEC is based on molecular size, while the intensity is the amount of a molecule that is present. In contrast to this, the utilization of the light scattering intensity obtained by SEC-MALLS (SEC, used as the separation technique, is coupled with a multiangle light scattering detector, making possible measurement of the weight-average molecular weight (Mw) and the molecular extension (mean square radius)) enables the determination of a molecular weight distribution not based on molecular size.

In conventional SEC, the molecular weight is measured by passing the molecules to be measured through a column, at which time they are subjected to a molecular sieving action and are eluted in sequence beginning with molecules having a larger molecular size. In this case, for a linear polymer and a branched polymer having the same molecular weight, the former, because it has a larger molecular size in solution, elutes more rapidly. Accordingly, the molecular weight measured by SEC for a branched polymer is generally smaller than the true molecular weight. On the other hand, the light scattering technique used by the present invention uses the Rayleigh scattering of the measured molecules. In addition, by carrying out measurement of the dependence of the intensity of the scattered light on the angle of incidence of the light and sample concentration and performing analysis using, for example, the Zimm or Berry method, a molecular weight (absolute molecular weight) closer to the true molecular weight can be determined for linear polymers and all molecular configurations of a branched polymer. In the present invention, the mean square radius ($Rg^2$) and the weight-average molecular weight (Mw) based on the absolute molecular weight were derived by measuring the intensity of the scattered light using the SEC-MALLS measurement procedure described below and analyzing the relationship given by the Zimm equation, infra, using a Debye plot. A Debye plot is a graph in which $K \cdot C/R(\theta)$ is plotted on the y-axis and $\sin^2(\theta/2)$ is plotted on the x-axis, and the weight-average molecular weight (Mw) can be calculated from the intercept with the y-axis and the mean square radius ($Rg^2$) can be calculated from the slope.

However, since Mw and $Rg^2$ are calculated for the component at each elution time, their average values must be further calculated in order to obtain Mw and $Rg^2$ for the sample as a whole.

When the measurements are performed using the instrument described below, the values of the radius of gyration (Rw) and the weight-average molecular weight (Mw) for the sample as a whole are obtained as direct output from the instrument.

$$\frac{K \cdot C}{R(\theta)} = \frac{1}{Mw} \cdot \frac{1}{P(\theta)} \text{ Zimm equation} \approx \frac{1}{Mw}\left[1 + \langle Rg^2 \rangle \sin^2\left(\frac{\theta}{2}\right) \cdot 16\pi^2/3\lambda^2\right] \quad \text{[Eq. 1]}$$

K optical constant

C: polymer concentration (g/mL)

R(θ): relative intensity of the scattered light at scattering angle θ

Mw: weight-average molecular weight

P(θ): factor showing the angular dependence of the scattered light $$P(\theta)=R(\theta)/R_0=1-\langle Rg^2 \rangle [4\pi/\lambda)\sin(\theta/2)]^2/3$$

$\langle Rg^2 \rangle$ : mean square radius

λ: wavelength (nm) of the laser light in the solution

Ortho-dichlorobenzene is used for the extraction solvent in the present invention.

The reason for this is that a correlation is seen for the magnetic toner of the present invention between the ortho-dichlorobenzene-soluble matter and the behavior during fixing.

This is thought to be due to the ability of ortho-dichlorobenzene—which has a high extraction capacity because it is a polar solvent and because it enables extraction at high temperatures, e.g., 135° C., due to its high boiling point of 180° C.—to extract a broad molecular weight band that is relevant to melting during fixing.

It is critical in the present invention that the weight-average molecular weight (Mw) measured on the ortho-dichlorobenzene-soluble matter from the magnetic toner using size exclusion chromatograph with a multiangle laser light scattering (SEC-MALLS) be from at least 5000 to not more than 20000. The viscosity when heat is applied to the magnetic toner can be lowered when the weight-average molecular weight (Mw) is not more than 20000. As a consequence, melting readily occurs during fixing and the cold offset is improved. In addition, when the weight-average molecular weight (Mw) is at least 5000, the magnetic toner then exhibits a high elasticity and stabilization during long-term use can be improved as a consequence. The fixed inorganic fine particles can also assume a more uniform presence on the fixed image surface after passage through the fixing nip, which as a consequence improves the releasability from the fixing film.

When this weight-average molecular weight (Mw) is greater than 20000, plasticization of the magnetic toner is impeded and the fixing performance deteriorates. When, on the other hand, the weight-average molecular weight (Mw) is less than 5000, the elasticity of the magnetic toner is prone to decline and the toner is easily deformed during long-term use and as a consequence the density and image quality readily decline.

As indicated above, the magnetic toner of the present invention also has a ratio [Rw/Mw] of the radius of gyration (Rw) to the weight-average molecular weight (Mw) of from at least $3.0\times10^{-3}$ to not more than $6.5\times10^{-3}$ and more preferably of from $5.0\times10^{-3}$ to not more than $6.5\times10^{-3}$.

The specification of an Rw/Mw of at least $3.0\times10^{-3}$ denotes a linear molecular structure, and, as noted above, serves to improve the sharp melt property and the cold offset property. In particular, Rw/Mw is particularly preferably brought to at least $5.0\times10^{-3}$ because this more readily provides a greater improvement in the sharp melt property.

When Rw/Mw is smaller than $3.0\times10^{-3}$, this denotes a branched-type molecular structure and leads to a reduction in the sharp melt property. The density during long-term use tends to be somewhat reduced when Rw/Mw is larger than $6.5\times10^{-3}$.

The weight-average molecular weight (Mw) here can be controlled into the above-described range by adjusting the type and amount of addition of the reaction initiator, the polymerization reaction temperature, and the vinyl monomer concentration in the dispersion medium during the polymerization reaction.

On the other hand, Rw/Mw can be controlled into the above-described range by adjusting the type and amount of addition of the reaction initiator, the polymerization reaction temperature, the vinyl monomer concentration in the dispersion medium during the polymerization reaction, and the type and amount of addition of a chain-transfer agent, and by adding, for example, a polymerization inhibitor.

Known chain-transfer agents can be used as the aforementioned chain-transfer agent. Examples here are mercaptans such as t-dodecyl mercaptan, n-dodecyl mercaptan, n-octyl mercaptan, and so forth, and halogenated hydrocarbons such as carbon tetrachloride, carbon tetrabromide, and so forth.

This chain-transfer agent can be added prior to the start of polymerization or during polymerization. The amount of chain-transfer agent addition, expressed per 100 mass parts of the vinyl monomer, is preferably from 0.001 to 10 mass parts and more preferably from 0.1 to 5 mass parts.

In the present invention, the viscosity of the magnetic toner at 110° C., measured by a flow tester/temperature ramp-up method, is from at least 5000 Pa·s to not more than 25000 Pa·s. This viscosity at 110° C. is preferably from at least 5000 Pa·s to not more than 20000 Pa·s.

With regard to the cold offset property, during the course of focused investigations as noted above the present inventors found that, among the properties of magnetic toners, the viscosity of a magnetic toner at high temperatures of at least 100° C. correlates with the cold offset property. Within this, a correlation by the viscosity at 110° C. was confirmed for film fixing, which is the preferred fixing method in the present invention. When one considers how 110° C. fits into the fixing process, it is thought to correspond to the temperature of the magnetic toner at the fixing nip and/or to the temperature at the time of release from the fixing film after passage through the fixing nip.

When this viscosity at 110° C. is not more than 25000 Pa·s, the magnetic toner can then undergo melting • plasticization • deformation and so forth at the fixing nip and as a consequence the fixing performance is enhanced and the cold offset property is improved.

When this viscosity at 110° C. is at least 5000 Pa·s, the viscosity of the magnetic toner itself is then relatively high and due to this a satisfactory adherence to the media, e.g., paper, is easily achieved. As a consequence, release from the fixing film after passage through the fixing nip is facilitated and the cold offset property is improved.

When this viscosity at 110° C. is less than 5000 Pa·s, release from the fixing film is impaired resulting in a deterioration in the cold offset property and/or the hot offset property, which is a problem when the fixing unit has been adequately heated. When, on the other hand, the viscosity at 110° C. exceeds 25000 Pa·s, the fixing performance is prone to be inadequate and the cold offset property deteriorates.

This viscosity at 110° C. can be controlled into the range indicated above by adjusting the weight-average molecular weight (Mw) of the binder resin and the ratio [Rw/Mw] for the binder resin of the radius of gyration (Rw) to the weight-average molecular weight (Mw) and by adjusting the type and amount of addition of the release agent.

Viewed from the standpoint of readily achieving a balanced coexistence between the storability and low-temperature fixability, the binder resin according to the present invention preferably has a glass-transition temperature (Tg) from 40° C. to 70° C. and more preferably from 50° C. to 70° C. The storability is readily improved when the Tg is at least 45° C. while the low-temperature fixability presents an improving trend when the Tg is not more than 70° C., and hence these are preferred.

The magnetic body present in the magnetic toner in the present invention can be exemplified by iron oxides such as magnetite, maghemite, ferrite, and so forth; metals such as iron, cobalt, and nickel; and alloys and mixtures of these metals with metals such as aluminum, copper, magnesium, tin, zinc, beryllium, calcium, manganese, selenium, titanium, tungsten, and vanadium.

The number-average particle diameter (D1) of the primary particles of this magnetic body is preferably not more than 0.50 μm and more preferably is from 0.05 μm to 0.30 μm.

This magnetic body preferably has the following magnetic properties for the application of 795.8 kA/m: a coercive force ($H_c$) preferably from 1.6 to 12.0 kA/m; a magnetization strength ($\sigma_s$) preferably from 50 to 200 $Am^2/kg$ and more preferably from 50 to 100 $Am^2/kg$; and a residual magnetization ($\sigma_r$) preferably from 2 to 20 $Am^2/kg$.

The magnetic toner of the present invention preferably contains from at least 35 mass % to not more than 50 mass % of the magnetic body and more preferably contains from at least 40 mass % to not more than 50 mass %.

When the content of the magnetic body in the magnetic toner is less than 35 mass %, the magnetic attraction to the magnet roll within the developing sleeve declines and fogging tends to be produced.

When, on the other hand, the magnetic body content exceeds 50 mass %, the developing performance presents a declining trend.

The content of the magnetic body in the magnetic toner can be measured using, for example, a Q5000IR TGA thermal analyzer from PerkinElmer Inc. With regard to the measurement method, the magnetic toner is heated from normal temperature to 900° C. under a nitrogen atmosphere at a rate of temperature rise of 25° C./minute: the mass loss from 100 to 750° C. is taken to be the component provided by subtracting the magnetic body from the magnetic toner and the residual mass is taken to be the amount of the magnetic body.

A charge control agent is preferably added to the magnetic toner of the present invention. The magnetic toner of the present invention is preferably a negative-charging toner.

Organometal complex compounds and chelate compounds are effective as charging agents for negative charging and can be exemplified by monoazo-metal complex compounds; acetylacetone-metal complex compounds; and metal complex compounds of aromatic hydroxycarboxylic acids and aromatic dicarboxylic acids.

Specific examples of commercially available products are Spilon Black TRH, T-77, and T-95 (Hodogaya Chemical Co., Ltd.) and BONTRON (registered trademark) S-34, S-44, S-54, E-84, E-88, and E-89 (Orient Chemical Industries Co., Ltd.).

A single one of these charge control agents may be used or two or more may be used in combination. Considered from the standpoint of the amount of charging of the magnetic toner, these charge control agents are used, expressed per 100 mass parts of the binder resin, preferably at from 0.1 to 10.0 mass parts and more preferably at from 0.1 to 5.0 mass parts.

The magnetic toner of the present invention preferably contains a release agent. A hydrocarbon wax, e.g., low molecular weight polyethylene, low molecular weight polypropylene, microcrystalline wax, paraffin wax, and so forth, is preferred for the release agent for the high releasability and ease of dispersion in the magnetic toner this provides.

The reason that hydrocarbon waxes are preferred is that they readily exhibit a lower compatibility with the binder resin than is exhibited by, for example, ester waxes, which as a consequence interferes with the compatibility with the binder resin when melting occurs during fixing and thereby facilitates the appearance of releasability. Due to this, the releasability from, for example, the fixing film, is improved and the appearance of cold offset is inhibited.

In addition, a single selection or two or more selections from the following waxes may as necessary be used in small amounts in combination. The following are provided as examples.

Examples include the oxides of aliphatic hydrocarbon waxes, such as oxidized polyethylene wax, and their block copolymers; waxes in which the main component is a fatty acid ester, such as carnauba wax, sasol wax, and montanic acid ester waxes; and products provided by the partial or complete deacidification of fatty acid esters, such as deacidified carnauba wax. Additional examples are as follows: saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; long-chain alkyl alcohols; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N-dioleylsebacamide; aromatic bisamides such as m-xylenebisstearamide and N,N-distearylisophthalamide; fatty acid metal salts (generally known as metal soaps) such as calcium stearate, calcium laurate, zinc stearate, and magnesium stearate; waxes provided by grafting on an aliphatic hydrocarbon wax using a vinyl monomer such as styrene or acrylic acid; partial esters between a polyhydric alcohol and a fatty acid, such as behenic monoglyceride; and hydroxyl-containing methyl ester compounds obtained by the hydrogenation of plant oils.

A value of 60 to 140° C. is preferred for the melting point defined by the peak temperature of the maximum endothermic peak during heating in measurement of the release agent with a differential scanning calorimeter (DSC). 60 to 90° C. is more preferred. A melting point of at least 60° C. is preferred because this facilitates adjustment into the viscosity range for the magnetic toner according to the present invention. On the other hand, a melting point of not more than 140° C. is preferred because this facilitates improvements in the low-temperature fixability.

The content of this release agent, expressed per 100 mass parts of the binder resin, is preferably from 0.1 to 20 mass parts and more preferably from 0.5 to 10 mass parts.

When the release agent content is at least 0.1 mass parts, release from the fixing film is facilitated and the cold offset property is readily improved. When, on the other hand, the release agent content is not more than 20 mass parts, deterioration of the magnetic toner during long-term use is inhibited and an improved image stability is thereby facilitated.

The release agent can be incorporated in the binder resin, for example, by methods in which during resin production the resin is dissolved in a solvent, the temperature of the resin solution is raised, and addition and mixing are carried out while stirring, or by methods in which addition is performed during melt kneading during toner production.

The magnetic toner of the present invention contains inorganic fine particles at the magnetic toner particle surface.

The inorganic fine particles present on the magnetic toner particle surface can be exemplified by silica fine particles, titania fine particles, and alumina fine particles, and these inorganic fine particles can also be favorably used after the execution of a hydrophobic treatment on the surface thereof.

It is critical that the inorganic fine particles present on the surface of the magnetic toner particles in the present invention contain at least one type of metal oxide fine particle selected from the group consisting of silica fine particles, titania fine particles, and alumina fine particles, and that at least 85 mass % of the metal oxide fine particles be silica fine particles. Preferably at least 90 mass % of the metal oxide fine particles are silica fine particles. The reasons for this are that silica fine particles not only provide the best balance with regard to imparting charging performance and flowability, but are also excellent from the standpoint of lowering the aggregative forces between the toners.

The reason why silica fine particles are excellent from the standpoint of lowering the aggregative forces between the toners are not entirely clear, but it is hypothesized that this is probably due to the substantial operation of the previously described bearing effect with regard to the sliding behavior between the silica fine particles.

In addition, silica fine particles are preferably the main component of the inorganic fine particles fixed to the magnetic toner particle surface. Specifically, the inorganic fine particles fixed to the magnetic toner particle surface preferably contain at least one type of metal oxide fine particle selected from the group consisting of silica fine particles, titania fine particles, and alumina fine particles wherein silica fine particles are at least 80 mass % of these metal oxide fine particles. The silica fine particles are more preferably at least 90 mass %. This is hypothesized to be for the same reasons as discussed above: silica fine particles are the best from the standpoint of imparting charging performance and flowability, and as a consequence a rapid initial rise in magnetic toner charge occurs. The result is that a high image density can be obtained, which is strongly preferred.

Here, the adjustment of the timing and amount of addition of the inorganic fine particles may be implemented to bring the silica fine particles to at least 85 mass % of the metal oxide fine particles present at the magnetic toner particle surface and in order to also bring the silica fine particles to at least 80 mass % in the metal oxide particles fixed on the magnetic toner particle surface.

The amount of inorganic fine particles present can be checked using the methods described below for quantitating the inorganic fine particles.

The number-average particle diameter (D1) of the primary particles in the inorganic fine particles in the present invention is preferably from at least 5 nm to not more than 50 nm and more preferably is from at least 10 nm to not more than 35 nm.

Bringing the number-average particle diameter (D1) of the primary particles in the inorganic fine particles into the aforementioned range facilitates favorable control of the coverage ratio A and B/A. When the primary particle number-average particle diameter (D1) is less than 5 nm, the inorganic fine particles are prone to aggregate with one another and not only is it then difficult to obtain large values for B/A, but the coefficient of variation on the coverage ratio A also readily assumes large values. When, on the other hand, the primary particle number-average particle diameter (D1) is larger than 50 nm, the coverage ratio A is then prone to be low even for large amounts of addition of the inorganic fine particles, while the value of B/A also tends to be low because the inorganic fine particles are difficult to fix to the magnetic toner particles. Thus, it is difficult to obtain the above-described attachment force-lowering effect and bearing effect when the primary particle number-average particle diameter (D1) is greater than 50 nm.

A hydrophobic treatment is preferably carried out on the inorganic fine particles used in the present invention, and particularly preferred inorganic fine particles will have been hydrophobically treated to a hydrophobicity, as measured by the methanol titration test, of at least 40% and more preferably at least 50%.

The method for carrying out the hydrophobic treatment can be exemplified by methods in which treatment is carried out with, e.g., an organosilicon compound, a silicone oil, a long-chain fatty acid, and so forth.

The organosilicon compound can be exemplified by hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. A single one of these can be used or a mixture of two or more can be used.

The silicone oil can be exemplified by dimethylsilicone oil, methylphenylsilicone oil, a-methylstyrene-modified silicone oil, chlorophenyl silicone oil, and fluorine-modified silicone oil.

A $C_{10-22}$ fatty acid is suitably used for the long-chain fatty acid, and the long-chain fatty acid may be a straight-chain fatty acid or a branched fatty acid. A saturated fatty acid or an unsaturated fatty acid may be used.

Among the preceding, $C_{10-22}$ straight-chain saturated fatty acids are highly preferred because they readily provide a uniform treatment of the surface of the inorganic fine particles.

These straight-chain saturated fatty acids can be exemplified by capric acid, lauric acid, myristic acid, palmitic acid, stearic acid, arachidic acid, and behenic acid.

Inorganic fine particles that have been treated with silicone oil are preferred for the inorganic fine particles used in the present invention, and inorganic fine particles treated with an organosilicon compound and a silicone oil are more preferred. This makes possible a favorable control of the hydrophobicity.

The method for treating the inorganic fine particles with a silicone oil can be exemplified by a method in which the silicone oil is directly mixed, using a mixer such as a HENSCHEL mixer, with inorganic fine particles that have been treated with an organosilicon compound, and by a method in which the silicone oil is sprayed on the inorganic fine particles. Another example is a method in which the silicone oil is dissolved or dispersed in a suitable solvent; the inorganic fine particles are then added and mixed; and the solvent is removed.

In order to obtain a good hydrophobicity, the amount of silicone oil used for the treatment, expressed per 100 mass parts of the inorganic fine particles, is preferably from at least 1 mass parts to not more than 40 mass parts and is more preferably from at least 3 mass parts to not more than 35 mass parts.

In order to impart an excellent flowability to the magnetic toner, the silica fine particles, titania fine particles, and alumina fine particles used by the present invention have a specific surface area as measured by the BET method based on nitrogen adsorption (BET specific surface area) preferably of from at least 20 $m^2/g$ to not more than 350 $m^2/g$ and more preferably of from at least 25 $m^2/g$ to not more than 300 $m^2/g$.

Measurement of the specific surface area (BET specific surface area) by the BET method based on nitrogen adsorption is performed based on JIS 28830 (2001). A "TriStar300 (Shimadzu Corporation) automatic specific surface area • pore distribution analyzer", which uses gas adsorption by a constant volume technique as its measurement procedure, is used as the measurement instrument.

The amount of addition of the inorganic fine particles, expressed per 100 mass parts of the magnetic toner particles, is preferably from at least 1.5 mass parts to not more than 3.0 mass parts of the inorganic fine particles, more preferably from at least 1.5 mass parts to not more than 2.6 mass parts, and even more preferably from at least 1.8 mass parts to not more than 2.6 mass parts.

With the amount of addition of the inorganic fine particles being set in the indicated range, the coverage ratio A and B/A can be controlled appropriately.

Exceeding 3.0 mass parts for the amount of addition of the inorganic fine particles, even if an external addition apparatus and an external addition method could be devised, gives rise to release of the inorganic fine particles and facilitates the appearance of, for example, a streak on the image.

In addition to the above-described inorganic fine particles, particles with a primary particle number-average particle diameter (D1) of from at least 80 nm to not more than 3 μm may be added to the magnetic toner of the present invention. For example, a lubricant, e.g., a fluororesin powder, zinc stearate powder, or polyvinylidene fluoride powder; a polish, e.g., a cerium oxide powder, a silicon carbide powder, or a strontium titanate powder; or a spacer particle such as silica, may also be added in small amounts that do not influence the effects.

Viewed from the standpoint of the balance between the developing performance and the fixing performance, the weight-average particle diameter (D4) of the magnetic toner of the present invention is preferably from at least 6.0 μm to not more than 10.0 μm and more preferably is from at least 7.0 μm to not more than 9.0 μm.

In addition, viewed from the standpoint of suppressing charge up, the average circularity of the magnetic toner of the present invention is preferably from at least 0.935 to not more than 0.955 and is more preferably from at least 0.938 to not more than 0.950.

The average circularity of the magnetic toner of the present invention can be adjusted into the indicated range by adjusting the method of producing the magnetic toner and by adjusting the production conditions.

Examples of methods for producing the magnetic toner of the present invention are provided below, but there is no intent to limit the production method to these.

The magnetic toner of the present invention can be produced by any known method that enables adjustment of the coverage ratio A and B/A and that preferably has a step in which the average circularity can be adjusted, while the other production steps are not particularly limited.

The following method is a favorable example of such a production method. First, the binder resin and magnetic body and as necessary other starting materials, e.g., a release agent and a charge control agent, are thoroughly mixed using a mixer such as a HENSCHEL mixer or ball mill and are then melted, worked, and kneaded using a heated kneading apparatus such as a roll, kneader, or extruder to compatibilize the resins with each other.

The obtained melted and kneaded material is cooled and solidified and then coarsely pulverized, finely pulverized, and classified, and the external additives, e.g., inorganic fine particles, are externally added and mixed into the resulting magnetic toner particles to obtain the magnetic toner.

The mixer used here can be exemplified by the HENSCHEL mixer (Mitsui Mining Co., Ltd.); Supermixer (Kawata Mfg. Co., Ltd.); Ribocone (Okawara Corporation); Nauta mixer, Turbulizer, and Cyclomix, Nobilta (Hosokawa Micron Corporation); Spiral Pin Mixer (Pacific Machinery & Engineering Co., Ltd.); and Loedige Mixer (Matsubo Corporation).

The aforementioned kneading apparatus can be exemplified by the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The aforementioned pulverizer can be exemplified by the Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

Among the preceding, the average circularity can be controlled by adjusting the exhaust gas temperature during micropulverization using a Turbo Mill. A lower exhaust gas temperature (for example, no more than 40° C.) provides a smaller value for the average circularity while a higher exhaust gas temperature (for example, around 50° C.) provides a higher value for the average circularity.

The aforementioned classifier can be exemplified by the Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles can be exemplified by the Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

Figure 4:
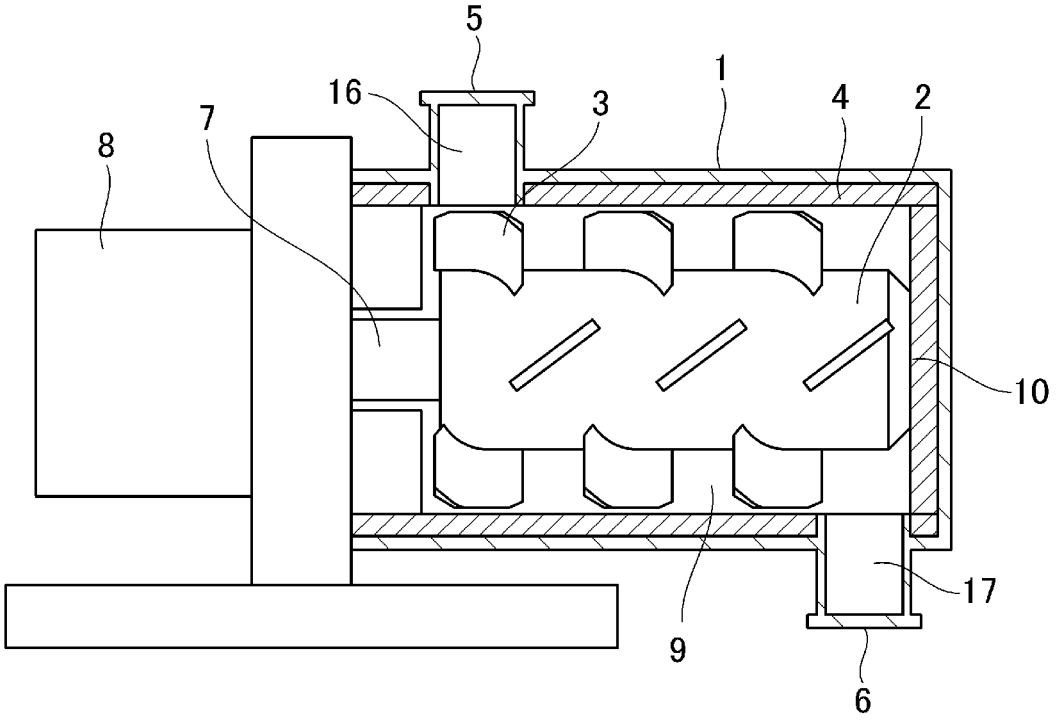
FIG. 4 is a schematic diagram that shows an example of a mixing process apparatus that can be used for the external addition and mixing of inorganic fine particles.

A known mixing process apparatus, e.g., the mixers described above, can be used for the external addition and mixing of the inorganic fine particles; however, an apparatus as shown in FIG. 4 is preferred from the standpoint of enabling facile control of the coverage ratio A, B/A, and the coefficient of variation on the coverage ratio A.

FIG. 4 is a schematic diagram that shows an example of a mixing process apparatus that can be used to carry out the external addition and mixing of the inorganic fine particles used by the present invention.

This mixing process apparatus readily brings about fixing of the inorganic fine particles to the magnetic toner particle surface because it has a structure that applies shear in a narrow clearance region to the magnetic toner particles and the inorganic fine particles.

Furthermore, as described below, the coverage ratio A, B/A, and coefficient of variation on the coverage ratio A are easily controlled into the ranges preferred for the present invention because circulation of the magnetic toner particles and inorganic fine particles in the axial direction of the rotating member is facilitated and because a thorough and uniform mixing is facilitated prior to the development of fixing.

Figure 5:
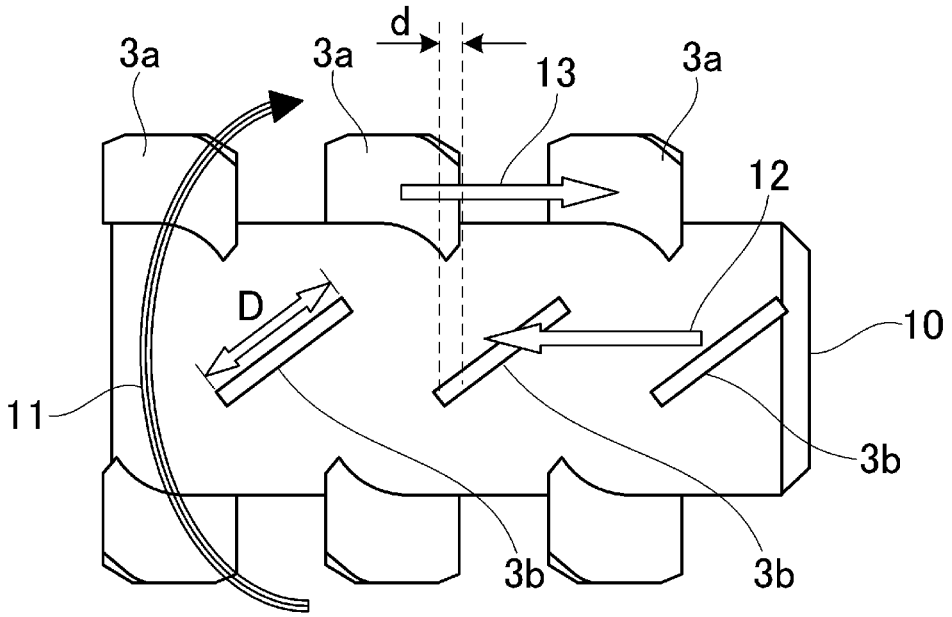
FIG. 5 is a schematic diagram that shows an example of the structure of a stirring member used in the mixing process apparatus.

On the other hand, FIG. 5 is a schematic diagram that shows an example of the structure of the stirring member used in the aforementioned mixing process apparatus.

The external addition and mixing process for the inorganic fine particles is described below using FIGS. 4 and 5.

This mixing process apparatus that carries out external addition and mixing of the inorganic fine particles has a rotating member 2, on the surface of which at least a plurality of stirring members 3 are disposed; a drive member 8, which drives the rotation of the rotating member; and a main casing 1, which is disposed to have a gap with the stirring members 3.

It is important that the gap (clearance) between the inner circumference of the main casing 1 and the stirring member 3 be maintained constant and very small in order to apply a uniform shear to the magnetic toner particles and facilitate the fixing of the inorganic fine particles to the magnetic toner particle surface.

The diameter of the inner circumference of the main casing 1 in this apparatus is not more than twice the diameter of the outer circumference of the rotating member 2. In FIG. 4, an example is shown in which the diameter of the inner circumference of the main casing 1 is 1.7-times the diameter of the outer circumference of the rotating member 2 (the trunk diameter provided by subtracting the stirring member 3 from the rotating member 2). When the diameter of the inner circumference of the main casing 1 is not more than twice the diameter of the outer circumference of the rotating member 2, impact force is satisfactorily applied to the magnetic toner particles since the processing space in which forces act on the magnetic toner particles is suitably limited.

In addition, it is important that the aforementioned clearance be adjusted in conformity to the size of the main casing. Viewed from the standpoint of the application of adequate shear to the magnetic toner particles, it is important that the clearance be made from about at least 1% to not more than 5% of the diameter of the inner circumference of the main casing 1. Specifically, when the diameter of the inner circumference of the main casing 1 is approximately 130 mm, the clearance is preferably made approximately from at least 2 mm to not more than 5 mm; when the diameter of the inner circumference of the main casing 1 is about 800 mm, the clearance is preferably made approximately from at least 10 mm to not more than 30 mm.

In the process of the external addition and mixing of the inorganic fine particles in the present invention, mixing and external addition of the inorganic fine particles to the magnetic toner particle surface are performed using the mixing process apparatus by rotating the rotating member 2 by the drive member 8 and stirring and mixing the magnetic toner particles and inorganic fine particles that have been introduced into the mixing process apparatus.

As shown in FIG. 5, at least a portion of the plurality of stirring members 3 is formed as a forward transport stirring member 3*a* that, accompanying the rotation of the rotating member 2, transports the magnetic toner particles and inorganic fine particles in one direction along the axial direction of the rotating member. In addition, at least a portion of the plurality of stirring members 3 is formed as a back transport stirring member 3*b* that, accompanying the rotation of the rotating member 2, returns the magnetic toner particles and inorganic fine particles in the other direction along the axial direction of the rotating member.

Here, when the raw material inlet port 5 and the product discharge port 6 are disposed at the two ends of the main casing 1, as in FIG. 4, the direction toward the product discharge port 6 from the raw material inlet port 5 (the direction to the right in FIG. 4) is the "forward direction".

That is, as shown in FIG. 5, the face of the forward transport stirring member 3*a* is tilted so as to transport the magnetic toner particles in the forward direction (13). On the other hand, the face of the back transport stirring member 3*b* is tilted so as to transport the magnetic toner particles and the inorganic fine particles in the back direction (12).

By doing this, the external addition of the inorganic fine particles to the surface of the magnetic toner particles and mixing are carried out while repeatedly performing transport in the "forward direction" (13) and transport in the "back direction" (12).

In addition, with regard to the stirring members 3*a*, 3*b*, a plurality of members disposed at intervals in the circumferential direction of the rotating member 2 form a set. In the example shown in FIG. 5, two members at an interval of 180° with each other form a set of the stirring members 3*a*, 3*b* on the rotating member 2, but a larger number of members may form a set, such as three at an interval of 120° or four at an interval of 90°.

In the example shown in FIG. 5, a total of twelve stirring members 3*a*, 3*b* are formed at an equal interval.

Furthermore, D in FIG. 5 indicates the width of a stirring member and d indicates the distance that represents the overlapping portion of a stirring member. In FIG. 5, D is preferably a width that is approximately from at least 20% to not more than 30% of the length of the rotating member 2, when considered from the standpoint of bringing about an efficient transport of the magnetic toner particles and inorganic fine particles in the forward direction and back direction. FIG. 5 shows an example in which D is 23%. Furthermore, with regard to the stirring members 3*a* and 3*b*, when an extension line is drawn in the perpendicular direction from the location of the end of the stirring member 3*a*, a certain overlapping portion d of the stirring member with the stirring member 3*b* is preferably present. This serves to efficiently apply shear to the magnetic toner particles. This d is preferably from at least 10% to not more than 30% of D from the standpoint of the application of shear.

In addition to the shape shown in FIG. 5, the blade shape may be—insofar as the magnetic toner particles can be transported in the forward direction and back direction and the clearance is retained—a shape having a curved surface or a paddle structure in which a distal blade element is connected to the rotating member 2 by a rod-shaped arm.

The present invention will be described in additional detail herebelow with reference to the schematic diagrams of the apparatus shown in FIGS. 4 and 5.

The apparatus shown in FIG. 4 has a rotating member 2, which has at least a plurality of stirring members 3 disposed on its surface; a drive member 8 that drives the rotation of the rotating member 2; a main casing 1, which is disposed forming a gap with the stirring members 3; and a jacket 4, in which a heat transfer medium can flow and which resides on the inside of the main casing 1 and at the end surface 10 of the rotating member.

In addition, the apparatus shown in FIG. 4 has a raw material inlet port 5, which is formed on the upper side of the main casing 1 for the purpose of introducing the magnetic toner particles and the inorganic fine particles, and a product discharge port 6, which is formed on the lower side of the main casing 1 for the purpose of discharging, from the main casing 1 to the outside, the magnetic toner that has been subjected to the external addition and mixing process.

The apparatus shown in FIG. 4 also has a raw material inlet port inner piece 16 inserted in the raw material inlet port 5 and a product discharge port inner piece 17 inserted in the product discharge port 6.

In the present invention, the raw material inlet port inner piece 16 is first removed from the raw material inlet port 5 and the magnetic toner particles are introduced into the processing space 9 from the raw material inlet port 5. Then, the inorganic fine particles are introduced into the processing space 9 from the raw material inlet port 5 and the raw material inlet port inner piece 16 is inserted. The rotating member 2 is subsequently rotated by the drive member 8 (11 represents the direction of rotation), and the thereby introduced material to be processed is subjected to the external addition and mixing process while being stirred and mixed by the plurality of stirring members 3 disposed on the surface of the rotating member 2.

The sequence of introduction may also be introduction of the inorganic fine particles through the raw material inlet port 5 first and then introduction of the magnetic toner particles through the raw material inlet port 5. In addition, the magnetic toner particles and the inorganic fine particles may be mixed in advance using a mixer such as a HENSCHEL mixer and the mixture may thereafter be introduced through the raw material inlet port 5 of the apparatus shown in FIG. 4.

More specifically, with regard to the conditions for the external addition and mixing process, controlling the power of the drive member 8 to from at least 0.2 W/g to not more than 2.0 W/g is preferred in terms of obtaining the coverage ratio A, B/A, and coefficient of variation on the coverage ratio A specified by the present invention. Controlling the power of the drive member 8 to from at least 0.6 W/g to not more than 1.6 W/g is more preferred.

When the power is lower than 0.2 W/g, it is difficult to obtain a high coverage ratio A, and B/A tends to be too low. On the other hand, B/A tends to be too high when 2.0 W/g is exceeded.

The processing time is not particularly limited, but is preferably from at least 3 minutes to not more than 10 minutes. When the processing time is shorter than 3 minutes, B/A tends to be low and a large coefficient of variation on the coverage ratio A is prone to occur. On the other hand, when the processing time exceeds 10 minutes, B/A conversely tends to be high and the temperature within the apparatus is prone to rise.

The rotation rate of the stirring members during external addition and mixing is not particularly limited; however, when, for the apparatus shown in FIG. 4, the volume of the processing space 9 in the apparatus is $2.0\times10^{-3}$ $m^3$, the rpm of the stirring members—when the shape of the stirring members 3 is as shown in FIG. 5—is preferably from at least 1000 rpm to not more than 3000 rpm. The coverage ratio A, B/A, and coefficient of variation on the coverage ratio A as specified for the present invention are readily obtained at from at least 1000 rpm to not more than 3000 rpm.

A particularly preferred processing method for the present invention has a pre-mixing step prior to the external addition and mixing process step. Inserting a pre-mixing step achieves a very uniform dispersion of the inorganic fine particles on the magnetic toner particle surface, and as a result a high coverage ratio A is readily obtained and the coefficient of variation on the coverage ratio A is readily reduced.

More specifically, the pre-mixing processing conditions are preferably a power of the drive member 8 of from at least 0.06 W/g to not more than 0.20 W/g and a processing time of from at least 0.5 minutes to not more than 1.5 minutes. It is difficult to obtain a satisfactorily uniform mixing in the pre-mixing when the loaded power is below 0.06 W/g or the processing time is shorter than 0.5 minutes for the pre-mixing processing conditions. When, on the other hand, the loaded power is higher than 0.20 W/g or the processing time is longer than 1.5 minutes for the pre-mixing processing conditions, the inorganic fine particles may become fixed to the magnetic toner particle surface before a satisfactorily uniform mixing has been achieved.

After the external addition and mixing process has been finished, the product discharge port inner piece 17 in the product discharge port 6 is removed and the rotating member 2 is rotated by the drive member 8 to discharge the magnetic toner from the product discharge port 6. As necessary, coarse particles and so forth may be separated from the obtained magnetic toner using a screen or sieve, for example, a circular vibrating screen, to obtain the magnetic toner.

Figure 3:
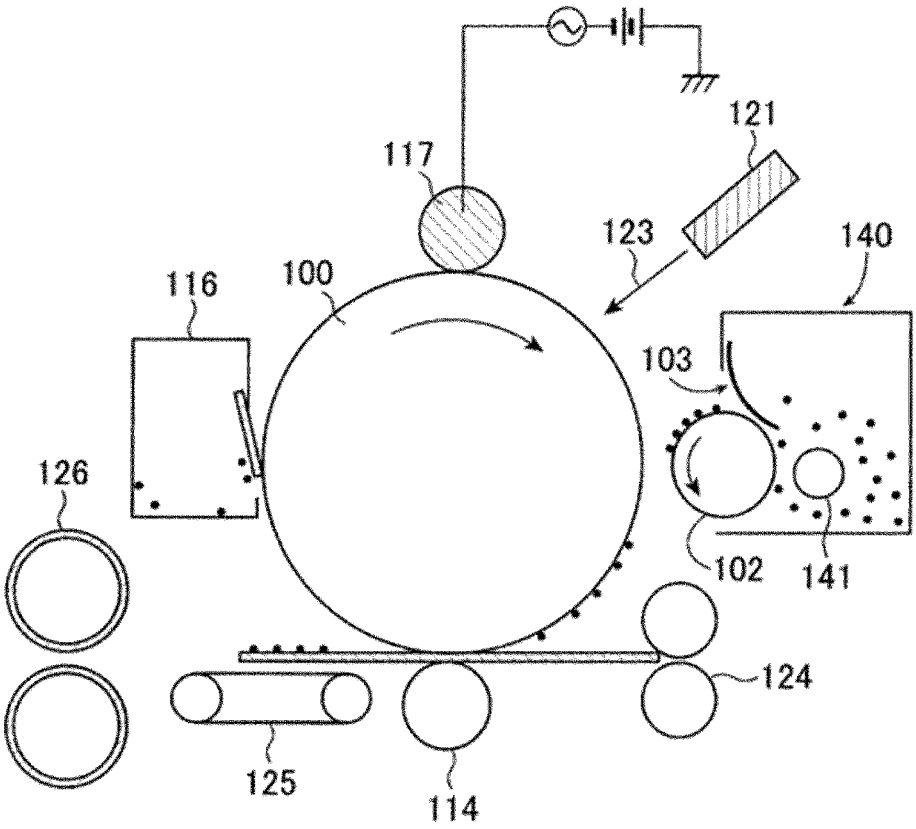
FIG. 3 is a schematic diagram that shows an example of an image-forming apparatus.

An example of an image-forming apparatus that can advantageously use the toner of the present invention is specifically described below with reference to FIG. 3. In FIG. 3, 100 is an electrostatic latent image-bearing member (also referred to below as a photosensitive member), and the following, inter alia, are disposed on its circumference: a charging member (charging roller) 117, a developing device 140 having a toner-carrying member 102, a transfer member (transfer charging roller) 114, a cleaner container 116, a fixing unit 126, and a pick-up roller 124. The electrostatic latent image-bearing member 100 is charged by the charging roller 117. Photoexposure is performed by irradiating the electrostatic latent image-bearing member 100 with laser light from a laser generator 121 to form an electrostatic latent image corresponding to the intended image. The electrostatic latent image on the electrostatic latent image-bearing member 100 is developed by the developing device 140 with a monocomponent toner to provide a toner image, and the toner image is transferred onto a transfer material by the transfer roller 114, which contacts the electrostatic latent image-bearing member with the transfer material interposed therebetween. The toner image-bearing transfer material is conveyed to the fixing unit 126 and fixing on the transfer material is carried out. In addition, the toner remaining to some extent on the electrostatic latent image-bearing member is scraped off by the cleaning blade and is stored in the cleaner container 116.

The methods for measuring the various properties pertaining to the present invention are described in the following.

<Quantitation Methods for the Inorganic Fine Particles>

(1) Determination of the Content of Silica Fine Particles in the Magnetic Toner (Standard Addition Method)

3 g of the magnetic toner is introduced into an aluminum ring having a diameter of 30 mm and a pellet is prepared using a pressure of 10 tons. The silicon (Si) intensity is determined (Si intensity-1) by wavelength-dispersive x-ray fluorescence analysis (XRF). The measurement conditions are preferably optimized for the XRF instrument used and all of the intensity measurements in a series are performed using the same conditions. Silica fine particles with a primary particle number-average particle diameter of 12 nm are added at 1.0 mass % with reference to the magnetic toner and mixing is carried out with a coffee mill.

For the silica fine particles admixed at this time, silica fine particles with a primary particle number-average particle diameter of from at least 5 nm to not more than 50 nm can be used without affecting this determination.

After mixing, pellet fabrication is carried out as described above and the Si intensity (Si intensity-2) is determined also as described above. Using the same procedure, the Si intensity (Si intensity-3, Si intensity-4) is also determined for samples prepared by adding and mixing the silica fine particles at 2.0 mass % and 3.0 mass % of the silica fine particles with reference to the magnetic toner. The silica content (mass %) in the magnetic toner based on the standard addition method is calculated using Si intensities-1 to -4.

The titania content (mass %) in the magnetic toner and the alumina content (mass %) in the magnetic toner are determined using the standard addition method and the same procedure as described above for the determination of the silica content. That is, for the titania content (mass %), titania fine particles with a primary particle number-average particle diameter of from at least 5 nm to not more than 50 nm are added and mixed and the determination can be made by determining the titanium (Ti) intensity. For the alumina content (mass %), alumina fine particles with a primary particle number-average particle diameter of from at least 5 nm to not more than 50 nm are added and mixed and the determination can be made by determining the aluminum (Al) intensity.

(2) Separation of the Inorganic Fine Particles from the Magnetic Toner 5 g of the magnetic toner is weighed using a precision balance into a lidded 200-mL plastic cup; 100 mL methanol is added; and dispersion is carried out for 5 minutes using an ultrasound disperser. The magnetic toner is held using a neodymium magnet and the supernatant is discarded. The process of dispersing with methanol and discarding the supernatant is carried out three times, followed by the addition of 100 mL of 10% NaOH and several drops of "Contaminon N" (a 10 mass % aqueous solution of a neutral pH 7 detergent for cleaning precision measurement instrumentation and comprising a nonionic surfactant, an anionic surfactant, and an organic builder, from Wako Pure Chemical Industries, Ltd.), light mixing, and then standing at quiescence for 24 hours. This is followed by re-separation using a neodymium magnet. Repeated washing with distilled water is carried out at this point until NaOH does not remain. The recovered particles are thoroughly dried using a vacuum drier to obtain particles A. The externally added silica fine particles are dissolved and removed by this process. Titania fine particles and alumina fine particles can remain present in particles A since they are sparingly soluble in 10% NaOH.

(3) Measurement of the Si Intensity in the Particles A 3 g of the particles A are introduced into an aluminum ring with a diameter of 30 mm; a pellet is fabricated using a pressure of 10 tons; and the Si intensity (Si intensity-5) is determined by wavelength-dispersive XRF. The silica content (mass %) in particles A is calculated using the Si intensity-5 and the Si intensities-1 to -4 used in the determination of the silica content in the magnetic toner.

(4) Separation of the Magnetic Body from the Magnetic Toner 100 mL of tetrahydrofuran is added to 5 g of the particles A with thorough mixing followed by ultrasound dispersion for 10 minutes. The magnetic body is held with a magnet and the supernatant is discarded. This process is performed 5 times to obtain particles B. This process can almost completely remove the organic component, e.g., resins, outside the magnetic body. However, because a tetrahydrofuran-insoluble matter in the resin can remain, the particles B provided by this process are preferably heated to 800° C. in order to burn off the residual organic component, and the particles C obtained after heating are approximately the magnetic body that was present in the magnetic toner.

Measurement of the mass of the particles C yields the magnetic body content W (mass %) in the magnetic toner. In order to correct for the increment due to oxidation of the magnetic body, the mass of particles C is multiplied by 0.9666 ($Fe_2O_3 \rightarrow Fe_3O_4$).

(5) Measurement of the Ti Intensity and Al Intensity in the Separated Magnetic Body Ti and Al may be present as impurities or additives in the magnetic body. The amount of Ti and Al attributable to the magnetic body can be detected by FP quantitation in wavelength-dispersive XRF. The detected amounts of Ti and Al are converted to titania and alumina and the titania content and alumina content in the magnetic body are then calculated.

The amount of externally added silica fine particles, the amount of externally added titania fine particles, and the amount of externally added alumina fine particles are calculated by substituting the quantitative values obtained by the preceding procedures into the following formulas.

amount of externally added silica fine particles (mass %)=silica content (mass %) in the magnetic toner−silica content (mass %) in particle *A* amount of externally added titania fine particles (mass %)=titania content (mass %) in the magnetic toner−{titania content (mass %) in the magnetic body×magnetic body content *W*/100} amount of externally added alumina fine particles (mass %)=alumina content (mass %) in the magnetic toner−{alumina content (mass %) in the magnetic body×magnetic body content *W*/100}

(6) Calculation of the Proportion of Silica Fine Particles in the Metal Oxide Fine Particles Selected from the Group Consisting of Silica Fine Particles, Titania Fine Particles, and Alumina Fine Particles, for the Inorganic Fine Particles Fixed to the Magnetic Toner Particle Surface.

After carrying out the procedure, "Removing the unfixed inorganic fine particles", in the method described below for calculating the coverage ratio B and thereafter drying the toner, the proportion of the silica fine particles in the metal oxide fine particles can be calculated by carrying out the same procedures as in the method of (1) to (5) described above.

<Method of Measuring the Number-Average Particle Diameter of the Primary Particles of the Inorganic Fine Particles>

The number-average particle diameter of the primary particles of the inorganic fine particles is calculated from the inorganic fine particle image on the magnetic toner surface taken with Hitachi's S-4800 ultrahigh resolution field emission scanning electron microscope (Hitachi High-Technologies Corporation). The conditions for image acquisition with the S-4800 are as follows.

The same steps (1) to (3) as described above in "Calculation of the coverage ratio A" are carried out; focusing is performed by carrying out focus adjustment at a 50000× magnification of the magnetic toner surface as in (4); and the brightness is then adjusted using the ABC mode. This is followed by bringing the magnification to 100000×; performing focus adjustment using the focus knob and STIGMA/ALIGNMENT knobs as in (4); and focusing using autofocus. The focus adjustment process is repeated to achieve focus at 100000×.

After this, the particle diameter is measured on at least 300 inorganic fine particles on the magnetic toner surface and the number-average particle diameter (D1) is determined. Here, because some inorganic fine particles are present as aggregates, the maximum diameter is determined on what can be identified as the primary particle, and the primary particle number-average particle diameter (D1) is obtained by taking the arithmetic average of the obtained maximum diameters.

<Calculation of the Coverage Ratio A>

The coverage ratio A is calculated in the present invention by analyzing, using Image-Pro Plus ver. 5.0 image analysis software (Nippon Roper Kabushiki Kaisha), the image of the magnetic toner surface taken with Hitachi's S-4800 ultrahigh resolution field emission scanning electron microscope (Hitachi High-Technologies Corporation). The conditions for image acquisition with the S-4800 are as follows.

(1) Specimen Preparation

An electroconductive paste is spread in a thin layer on the specimen stub (15 mm×6 mm aluminum specimen stub) and the magnetic toner is sprayed onto this. Additional blowing with air is performed to remove excess magnetic toner from the specimen stub and carry out thorough drying. The specimen stub is set in the specimen holder and the specimen stub height is adjusted to 36 mm with the specimen height gauge.

(2) Setting the Conditions for Observation with the S-4800

The coverage ratio A is calculated using the image obtained by backscattered electron imaging with the S-4800. The coverage ratio A can be measured with excellent accuracy using the backscattered electron image because the inorganic fine particles are charged up less than is the case with the secondary electron image.

Introduce liquid nitrogen to the brim of the anti-contamination trap located in the S-4800 housing and allow to stand for 30 minutes. Start the "PC-SEM" of the S-4800 and perform flashing (the FE tip, which is the electron source, is cleaned). Click the acceleration voltage display area in the control panel on the screen and press the [flashing] button to open the flashing execution dialog. Confirm a flashing intensity of 2 and execute. Confirm that the emission current due to flashing is 20 to 40 μA. Insert the specimen holder in the specimen chamber of the S-4800 housing. Press [home] on the control panel to transfer the specimen holder to the observation position.

Click the acceleration voltage display area to open the HV setting dialog and set the acceleration voltage to [0.8 kV] and the emission current to [20 μA]. In the [base] tab of the operation panel, set signal selection to [SE]; select [upper(U)] and [+BSE] for the SE detector; and select [L.A. 100] in the selection box to the right of [+BSE] to go into the observation mode using the backscattered electron image. Similarly, in the [base] tab of the operation panel, set the probe current of the electron optical system condition block to [Normal]; set the focus mode to [UHR]; and set WD to [3.0 mm]. Push the [ON] button in the acceleration voltage display area of the control panel and apply the acceleration voltage.

(3) Calculation of the Number-Average Particle Diameter (D1) of the Magnetic Toner Set the magnification to 5000× (5 k) by dragging within the magnification indicator area of the control panel. Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus with the autofocus. Focus by repeating this operation an additional two times.

After this, determine the number-average particle diameter (D1) by measuring the particle diameter at 300 magnetic toner particles. The particle diameter of the individual particle is taken to be the maximum diameter when the magnetic toner particle is observed.

(4) Focus Adjustment

For particles with a number-average particle diameter (D1) obtained in (3) of ±0.1 μm, with the center of the maximum diameter adjusted to the center of the measurement screen, drag within the magnification indication area of the control panel to set the magnification to 10000× (10 k). Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus using autofocus. Then set the magnification to 50000× (50 k); carry out focus adjustment as above using the focus knob and the STIGMA/ALIGNMENT knob; and re-focus using autofocus. Focus by repeating this operation. Here, because the accuracy of the coverage ratio measurement is prone to decline when the observation plane has a large tilt angle, carry out the analysis by making a selection with the least tilt in the surface by making a selection during focus adjustment in which the entire observation plane is simultaneously in focus.

(5) Image Capture

Carry out brightness adjustment using the ABC mode and take a photograph with a size of 640×480 pixels and store. Carry out the analysis described below using this image file. Take one photograph for each magnetic toner particle and obtain images for at least 30 magnetic toner particles.

(6) Image Analysis

The coverage ratio A is calculated in the present invention using the analysis software indicated below by subjecting the image obtained by the above-described procedure to binarization processing. When this is done, the above-described single image is divided into 12 squares and each is analyzed. However, when an inorganic fine particle with a particle diameter greater than or equal to 50 nm is present within a partition, calculation of the coverage ratio A is not performed for this partition.

The analysis conditions with the Image-Pro Plus ver. 5.0 image analysis software are as follows.

Software: Image-ProPlus5.1J

From "measurement" in the tool-bar, select "count/size" and then "option" and set the binarization conditions. Select 8 links in the object extraction option and set smoothing to 0. In addition, preliminary screening, fill vacancies, and envelope are not selected and the "exclusion of boundary line" is set to "none". Select "measurement items" from "measurement" in the tool-bar and enter 2 to $10^7$ for the area screening range.

The coverage ratio is calculated by marking out a square zone. Here, the area (C) of the zone is made 24000 to 26000 pixels. Automatic binarization is performed by "processing"-binarization and the total area (D) of the silica-free zone is calculated.

The coverage ratio a is calculated using the following formula from the area C of the square zone and the total area D of the silica-free zone.

$$\text{coverage ratio } a(\%)=100-(D/C\times 100)$$

As noted above, calculation of the coverage ratio a is carried out for at least 30 magnetic toner particles. The average value of all the obtained data is taken to be the coverage ratio A of the present invention.

< The Coefficient of Variation on the Coverage Ratio A>

The coefficient of variation on the coverage ratio A is determined in the present invention as follows. The coefficient of variation on the coverage ratio A is obtained using the following formula when σ(A) is the standard deviation on all the coverage ratio data used in the calculation of the coverage ratio A described above.

$$\text{coefficient of variation}(\%)=\{\sigma(A)/A\}\times 100$$

<Calculation of the Coverage Ratio B>

The coverage ratio B is calculated by first removing the unfixed inorganic fine particles on the magnetic toner surface and thereafter carrying out the same procedure as followed for the calculation of the coverage ratio A.

(1) Removal of the Unfixed Inorganic Fine Particles

The unfixed inorganic fine particles are removed as described below. The present inventors investigated and then set these removal conditions in order to thoroughly remove the inorganic fine particles other than those embedded in the toner surface.

Figure 6:
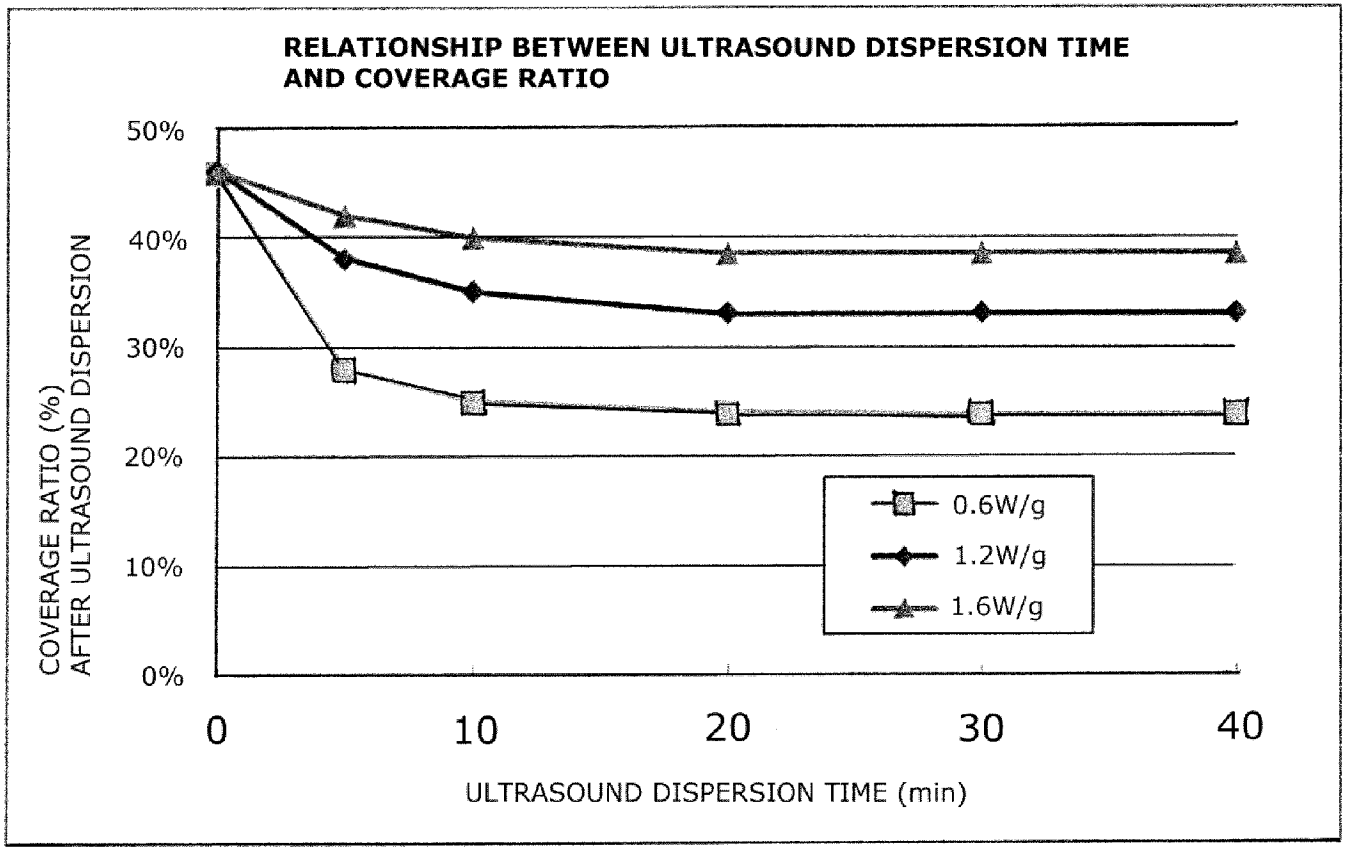
FIG. 6 is a diagram that shows an example of the relationship between the ultrasound dispersion time and the coverage ratio.

As an example, FIG. 6 shows the relationship between the ultrasound dispersion time and the coverage ratio calculated post-ultrasound dispersion, for magnetic toners in which the coverage ratio A was brought to 46% using the apparatus in FIG. 4 at three different external addition intensities. FIG. 6 was constructed by calculating, using the same procedure as for the calculation of coverage ratio A as described above, the coverage ratio of a magnetic toner provided by removing the inorganic fine particles by ultrasound dispersion by the method described below and then drying.

FIG. 6 demonstrates that the coverage ratio declines in association with removal of the inorganic fine particles by ultrasound dispersion and that, for all of the external addition intensities, the coverage ratio is brought to an approximately constant value by ultrasound dispersion for 20 minutes. Based on this, ultrasound dispersion for 30 minutes was regarded as providing a thorough removal of the inorganic fine particles other than the inorganic fine particles embedded in the toner surface and the thereby obtained coverage ratio was defined as coverage ratio B.

Considered in greater detail, 16.0 g of water and 4.0 g of Contaminon N (a neutral detergent from Wako Pure Chemical Industries, Ltd., product No. 037-10361) are introduced into a 30 mL glass vial and are thoroughly mixed. 1.50 g of the magnetic toner is introduced into the resulting solution and the magnetic toner is completely submerged by applying a magnet at the bottom. After this, the magnet is moved around in order to condition the magnetic toner to the solution and remove air bubbles.

The tip of a UH-50 ultrasound oscillator (from SMT Co., Ltd., the tip used is a titanium alloy tip with a tip diameter ϕ of 6 mm) is inserted so it is in the center of the vial and resides at a height of 5 mm from the bottom of the vial, and the inorganic fine particles are removed by ultrasound dispersion. After the application of ultrasound for 30 minutes, the entire amount of the magnetic toner is removed and dried. During this time, as little heat as possible is applied while carrying out vacuum drying at not more than 30° C.

(2) Calculation of the Coverage Ratio B

After the drying as described above, the coverage ratio of the magnetic toner is calculated as for the coverage ratio A described above, to obtain the coverage ratio B.

<Method for Measuring the Weight-Average Particle Diameter (D4) and the Particle Size Distribution of the Magnetic Toner>

The weight-average particle diameter (D4) of the magnetic toner is calculated as follows. The measurement instrument used is a "Coulter Counter Multisizer 3" (registered trademark, from Beckman Coulter, Inc.), a precision particle size distribution measurement instrument operating on the pore electrical resistance principle and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25000 channels for the number of effective measurement channels.

The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the dedicated software.

(2) Approximately 30 mL of the above-described aqueous electrolyte solution is introduced into a 100-mL flatbottom glass beaker. To this is added as dispersant about 0.3 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of ion-exchanged water is introduced into the water tank of this ultrasound disperser and approximately 2 mL of Contaminon N is added to the water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be at least 10° C. and not more than 40° C.

(6) Using a pipette, the dispersed toner-containing aqueous electrolyte solution prepared in (5) is dripped into the round-bottom beaker set in the sample stand as described in (1) with adjustment to provide a measurement concentration of about 5%. Measurement is then performed until the number of measured particles reaches 50000.

(7) The measurement data is analyzed by the previously cited software provided with the instrument and the weight-average particle diameter (D4) is calculated. When set to graph/volume % with the dedicated software, the "average diameter" on the "analysis/volumetric statistical value (arithmetic average)" screen is the weight-average particle diameter (D4).

<Method of Measuring the Average Circularity of the Magnetic Toner>

The average circularity of the magnetic toner is measured with the "FPIA-3000" (Sysmex Corporation), a flow-type particle image analyzer, using the measurement and analysis conditions from the calibration process.

The specific measurement method is as follows. First, approximately 20 mL of ion-exchanged water from which the solid impurities and so forth have previously been removed is placed in a glass container. To this is added as dispersant about 0.2 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.). Approximately 0.02 g of the measurement sample is also added and a dispersion treatment is carried out for 2 minutes using an ultrasound disperser to provide a dispersion for submission to measurement. Cooling is carried out as appropriate during this treatment so as to provide a dispersion temperature of at least 10° C. and no more than 40° C. The ultrasound disperser used here is a benchtop ultrasonic cleaner/disperser that has an oscillation frequency of 50 kHz and an electrical output of 150 W (for example, a "VS-150" from Velvo-Clear Co., Ltd.); a prescribed amount of ion-exchanged water is introduced into the water tank and approximately 2 mL of the aforementioned Contaminon N is also added to the water tank.

The previously cited flow-type particle image analyzer (fitted with a standard objective lens (10×)) is used for the measurement, and Particle Sheath "PSE-900A" (Sysmex Corporation) is used for the sheath solution. The dispersion prepared according to the procedure described above is introduced into the flow-type particle image analyzer and 3000 of the magnetic toner are measured according to total count mode in HPF measurement mode. The average circularity of the magnetic toner is determined with the binarization threshold value during particle analysis set at 85% and the analyzed particle diameter limited to a circle-equivalent diameter of from at least 1.985 μm to less than 39.69 μm.

For this measurement, automatic focal point adjustment is performed prior to the start of the measurement using reference latex particles (for example, a dilution with ion-exchanged water of "RESEARCH AND TEST PARTICLES Latex Microsphere Suspensions 5200A" from Duke Scientific). After this, focal point adjustment is preferably performed every two hours after the start of measurement.

In the present invention, the flow-type particle image analyzer used had been calibrated by the Sysmex Corporation and had been issued a calibration certificate by the Sysmex Corporation. The measurements are carried out under the same measurement and analysis conditions as when the calibration certificate was received, with the exception that the analyzed particle diameter is limited to a circle-equivalent diameter of from at least 1.985 μm to less than 39.69 μm.

The "FPIA-3000" flow-type particle image analyzer (Sysmex Corporation) uses a measurement principle based on taking a still image of the flowing particles and performing image analysis. The sample added to the sample chamber is delivered by a sample suction syringe into a flat sheath flow cell. The sample delivered into the flat sheath flow is sandwiched by the sheath liquid to form a flat flow. The sample passing through the flat sheath flow cell is exposed to stroboscopic light at an interval of 1/60 seconds, thus enabling a still image of the flowing particles to be photographed. Moreover, since flat flow is occurring, the photograph is taken under in-focus conditions. The particle image is photographed with a CCD camera; the photographed image is subjected to image processing at an image processing resolution of 512×512 pixels (0.37×0.37 μm per pixel); contour definition is performed on each particle image; and, among other things, the projected area S and the periphery length L are measured on the particle image.

The circle-equivalent diameter and the circularity are then determined using this area S and periphery length L. The circle-equivalent diameter is the diameter of the circle that has the same area as the projected area of the particle image. The circularity is defined as the value provided by dividing the circumference of the circle determined from the circle-equivalent diameter by the periphery length of the particle's projected image and is calculated using the following formula.

$$\text{circularity}=2\times(\pi\times S)^{1/2}/L$$

The circularity is 1.000 when the particle image is a circle, and the value of the circularity declines as the degree of irregularity in the periphery of the particle image increases. After the circularity of each particle has been calculated, 800 are fractionated out in the circularity range of 0.200 to 1.000; the arithmetic average value of the obtained circularities is calculated; and this value is used as the average circularity.

<Measurement of the Weight-Average Molecular Weight (Mw) and the Radius of Gyration (Rw) Using Size Exclusion Chromatograph with a Multiangle Laser Light Scattering (SEC-MALLS)>

0.03 g of the magnetic toner is dispersed in 10 mL of ortho-dichlorobenzene followed by shaking for 24 hours at 135° C. using a shaker. Filtration is then performed using a 0.2 μm filter and the ortho-dichlorobenzene-soluble matter in the magnetic toner is obtained as the filtrate. The measurement is carried out using this filtrate as the sample and using the following analytical conditions.

[Analytical Conditions]

separation column: TSKgel GMHHR-H(20) HT×2 (Tosoh Corporation)

column temperature: 135° C.

mobile phase solvent: ortho-dichlorobenzene mobile phase flow rate: 1.0 mL/min sample concentration: approximately 0.3% injection amount: 300 μL detector 1: multiangle light scattering detector (Wyatt DAWN EOS: Wyatt Technology Corporation)

detector 2: differential refractive index detector (Shodex RI-71: Showa Denko Kabushiki Kaisha)

The weight-average molecular weight (Mw) and the radius of gyration (Rw) were determined by analysis of the obtained measurement results with ASTRA for Windows (registered trademark) 4.73.04 (Wyatt Technology Corporation) analytical software.

<Method for Measuring the Viscosity of the Magnetic Toner Using a Flow Tester/Temperature Ramp-Up Method>

The viscosity of the magnetic toner at 110° C. by a flow tester/temperature ramp-up method is determined as follows.

The measurement is carried out by the following procedure using a Flow Tester Model CFT-500A (Shimadzu Corporation).

1.00 g of the sample is weighed out. Using a molder, this is pressed for 1 minute at a load of 10 MPa. Using this pressed sample, the viscosity at 110° C. is measured at normal temperature and normal humidity (temperature approximately 20 to 30° C., humidity 30 to 70% RH) using the measurement instrument indicated above and the conditions indicated below. The temperature ramp-up method is used for the measurement mode.

| | | |
|---|---|---|
| RATE TEMP | 4.0 | D/M (° C./min) |
| SET TEMP | 50.0 | DEG (° C.) |
| MAX TEMP | 200.0 | DEG |
| INTERVAL | 4.0 | DEG |
| PREHEAT | 300.0 | SEC (sec) |
| LOAD | 10.0 | KGF (kg) |
| DIE (DIA) | 1.0 | MM (mm) |
| DIE (LENG) | 1.0 | MM |
| PLUNGER | 1.0 | $CM^2$ ($cm^2$) |

EXAMPLES

The present invention is described in additional detail through the examples and comparative examples provided below. The "parts" and "%" in the description that follows are in all instances on a mass basis unless specifically indicated otherwise.

<Production Example for Low Molecular Weight Polymer (L-1)>

300 mass parts of xylene was introduced into a four-neck flask and heated under reflux and a mixture of 80 mass parts of styrene, 20 mass parts of n-butyl acrylate, and 2 mass parts of di-tert-butyl peroxide as polymerization initiator was added dropwise over 5 hours to obtain a solution of low molecular weight polymer (L-1).

<Production Example for High Molecular Weight Polymer (Type H-1)>

A high molecular weight polymer, designated high molecular weight polymer (type H-1), was prepared using the monomer, polymerization initiator, and chain-transfer agent shown in Table 1 and adjusting the reaction temperature, amount of polymerization initiator, and amount of chain-transfer agent.

An example of the production of high molecular weight polymer (H-1) is as follows. 180 mass parts of degassed water and 20 mass parts of a 2 mass % aqueous solution of polyvinyl alcohol were introduced into a four-neck flask, followed by the addition of a mixture of 75 mass parts of styrene as monomer 1, 25 mass parts of n-butyl acrylate as monomer 2, 0.005 mass parts of divinylbenzene as crosslinker, 1.0 mass part of t-dodecyl mercaptan as chain-transfer agent, and 3.0 mass parts of benzoyl peroxide as polymerization initiator and stirring to produce a suspension. The flask interior was thoroughly replaced with nitrogen; the temperature was raised to 85° C. to carry out polymerization; and the polymerization of high molecular weight polymer (H-1) was completed by holding for 24 hours.

<Production Examples for High Molecular Weight Polymers (Type H-2) to (Type H-4)>

High molecular weight polymers (type H-2) to (type H-4) were obtained proceeding in the same manner, but changing the monomer, polymerization initiator, and chain-transfer agent for high molecular weight polymer (type H-1) to that shown in Table 1.

TABLE 1

| high molecular weight species | monomer 1 | monomer 2 | polymerization initiator | chain-transfer agent |
|---|---|---|---|---|
| type H-1 | styrene monomer | n-butyl acrylate | benzoyl peroxide | t-dodecyl mercaptan |
| type H-2 | styrene monomer | n-butyl acrylate | dilauroyl peroxide | t-dodecyl mercaptan |
| type H-3 | styrene monomer | 2-ethylhexyl acrylate | benzoyl peroxide | t-dodecyl mercaptan |
| type H-4 | styrene monomer | n-butyl acrylate | dilauroyl peroxide | — |

<Production Example for Styrene/n-Butyl Acrylate (St/nBA) Copolymer 1>

25 mass parts of the high molecular weight polymer (H-1) was introduced into 300 mass parts of the uniform solution of low molecular weight polymer (L-1) and thorough mixing was carried out under reflux. This was followed by the distillative removal of the organic solvent to yield a styrene/n-butyl acrylate copolymer 1. This binder resin had an acid value of 0 mg KOH/g, a hydroxyl value of 0 mg KOH/g, a glass-transition temperature (Tg) of 56° C., an Mw of 11000, and an Rw/Mw of 5.2.

<Production Examples for Styrene/n-Butyl Acrylate (St/nBA) Copolymers 2 to 28>

Styrene/n-butyl acrylate (St/nBA) copolymers 2 to 28 were produced according to Production Example for Styrene/n-Butyl Acrylate (St/nBA) Copolymer 1, but changing the high molecular weight polymer as shown in Table 2.

TABLE 2

| binder resin | L type | H type | weight-average molecular weight Mw (SEC-MALLS) | Rw/Mw (SEC-MALLS) |
|---|---|---|---|---|
| St/nBA copolymer 1 | L-1 | type H-1 | 11000 | 5.2 |
| St/nBA copolymer 2 | L-1 | type H-1 | 10000 | 5.0 |
| St/nBA copolymer 3 | L-1 | type H-1 | 10000 | 4.8 |
| St/nBA copolymer 4 | L-1 | type H-2 | 11000 | 6.0 |
| St/nBA copolymer 5 | L-1 | type H-4 | 11000 | 2.8 |
| St/nBA copolymer 6 | L-1 | type H-1 | 5500 | 5.6 |
| St/nBA copolymer 7 | L-1 | type H-3 | 21000 | 5.4 |
| St/nBA copolymer 8 | L-1 | type H-4 | 6000 | 4.9 |
| St/nBA copolymer 9 | L-1 | type H-2 | 20000 | 5.1 |
| St/nBA copolymer 10 | L-1 | type H-4 | 6000 | 4.9 |
| St/nBA copolymer 11 | L-1 | type H-2 | 22000 | 4.7 |
| St/nBA copolymer 12 | L-1 | type H-2 | 13000 | 6.6 |
| St/nBA copolymer 13 | L-1 | type H-2 | 10000 | 6.3 |
| St/nBA copolymer 14 | L-1 | type H-4 | 9000 | 2.9 |
| St/nBA copolymer 15 | L-1 | type H-1 | 6000 | 6.6 |
| St/nBA copolymer 16 | L-1 | type H-3 | 21000 | 6.5 |
| St/nBA copolymer 17 | L-1 | type H-4 | 6000 | 3.0 |
| St/nBA copolymer 18 | L-1 | type H-1 | 21000 | 3.1 |
| St/nBA copolymer 19 | L-1 | type H-2 | 12000 | 6.7 |
| St/nBA copolymer 20 | L-1 | type H-4 | 11000 | 2.4 |
| St/nBA copolymer 21 | L-1 | type H-1 | 5800 | 4.9 |
| St/nBA copolymer 22 | L-1 | type H-3 | 23000 | 5.3 |
| St/nBA copolymer 23 | L-1 | type H-4 | 8500 | 3.0 |
| St/nBA copolymer 24 | L-1 | type H-4 | 8000 | 2.5 |
| St/nBA copolymer 25 | L-1 | type H-1 | 5800 | 6.7 |
| St/nBA copolymer 26 | L-1 | type H-3 | 23000 | 6.8 |
| St/nBA copolymer 27 | L-1 | type H-4 | 5800 | 2.7 |
| St/nBA copolymer 28 | L-1 | type H-1 | 23000 | 2.8 |

<Magnetic Toner Particle Production Examples 1>

| | |
|---|---|
| styrene/n-butyl acrylate copolymer 1 shown in Table 2 | 100.0 mass parts |
| polyethylene wax 1 shown in Table 3 | 8.0 mass parts |
| magnetic body (composition: $Fe_3O_4$, shape: spherical, primary particle number-average particle diameter: 0.21 μm, magnetic characteristics for 795.8 kA/m: $H_c$ = 5.5 kA/m, $\sigma_s$ = 84.0 $Am^2/kg$, and $\sigma_r$ = 6.4 $Am^2/kg$) | 95.0 mass parts |
| T-77 charge control agent (Hodogaya Chemical Co., Ltd.) | 1.0 mass part |

The raw materials listed above were preliminarily mixed using an FM10C Henschel mixer (Mitsui Miike Chemical Engineering Machinery Co., Ltd.) and were then kneaded with a twin-screw kneader/extruder (PCM-30, Ikegai Ironworks Corporation) set at a rotation rate of 200 rpm with the set temperature being adjusted to provide a direct temperature in the vicinity of the outlet for the kneaded material of 155° C.

The resulting melt-kneaded material was cooled; the cooled melt-kneaded material was coarsely pulverized with a cutter mill; the resulting coarsely pulverized material was finely pulverized using a Turbo Mill T-250 (Turbo Kogyo Co., Ltd.) at a feed rate of 20 kg/hr with the air temperature adjusted to provide an exhaust gas temperature of 38° C.; and classification was performed using a Coanda effect-based multifraction classifier to obtain a magnetic toner particle 1 having a weight-average particle diameter (D4) of 7.8 μm. The results are shown in Table 4.

<Magnetic Toner Particle Production Examples 2 to 48>

Magnetic toner particles 2 to 48 were obtained proceeding as in Magnetic Toner Particle Production Example 1, but using the binder resin shown in Table 2 and the release agent shown in Table 3 and changing the type of binder resin and type and content of the release agent in Magnetic Toner Particle Production Example 1 as shown in Table 4. The production conditions for magnetic toner particles 2 to 48 are shown in Table 4.

<Magnetic Toner Particle Production Example 49>

External addition prior to a hot wind treatment was performed by mixing 100 mass parts of magnetic toner particles 1 using an FM10C HENSCHEL mixer (Mitsui Miike Chemical Engineering Machinery Co., Ltd.) with 0.5 mass parts of the silica fine particles used in the external addition and mixing process of Magnetic Toner Production Example 1. The external addition conditions here were a rotation rate of 3000 rpm and a processing time of 2 minutes.

Then, after being subjected to this external addition prior to a hot wind treatment, the magnetic toner particles were subjected to surface modification using a Meteorainbow (Nippon Pneumatic Mfg. Co., Ltd.), which is a device that carries out the surface modification of toner particles using a hot wind blast. The surface modification conditions were a raw material feed rate of 2 kg/hr, a hot wind flow rate of 700 L/min, and a hot wind ejection temperature of 300° C. Magnetic toner particles 49 were obtained by carrying out this hot wind treatment.

<Magnetic Toner Particle Production Example 50>

Magnetic toner particle 50 was obtained by following the same procedure as in Magnetic Toner Particle Production Example 49, but in this case using 1.5 mass parts for the amount of addition of the silica fine particles in the external addition prior to the hot wind treatment in Magnetic Toner Particle Production Example 49.

TABLE 3

| release agent | melting point (° C.) |
|---|---|
| polyethylene wax 1 | 75 |
| polyethylene wax 2 | 60 |
| polyethylene wax 3 | 58 |
| polyethylene wax 4 | 90 |
| polyethylene wax 5 | 92 |
| polyethylene wax 6 | 80 |
| polyethylene wax 7 | 70 |
| ester wax (myristyl myristate) | 43 |

TABLE 4

| | binder resin | release agent | | direct temperature of the kneaded material (° C.) | exhaust temperature during fine pulverization (° C.) | weight-average particle diameter D4 (μm) |
|---|---|---|---|---|---|---|
| magnetic toner particle 1 | St/nBA copolymer 1 | polyethylene wax 1 | 8 mass parts | 155 | 38 | 7.8 |
| magnetic toner particle 2 | St/nBA copolymer 1 | polyethylene wax 1 | 10 mass parts | 155 | 38 | 7.8 |
| magnetic toner particle 3 | St/nBA copolymer 1 | polyethylene wax 1 | 11 mass parts | 155 | 39 | 7.8 |
| magnetic toner particle 4 | St/nBA copolymer 1 | polyethylene wax 1 | 6 mass parts | 155 | 38 | 7.8 |
| magnetic toner particle 5 | St/nBA copolymer 1 | polyethylene wax 1 | 5 mass parts | 155 | 38 | 7.8 |
| magnetic toner particle 6 | St/nBA copolymer 1 | polyethylene wax 2 | 8 mass parts | 155 | 38 | 7.8 |
| magnetic toner particle 7 | St/nBA copolymer 1 | polyethylene wax 3 | 8 mass parts | 155 | 38 | 7.8 |
| magnetic toner particle 8 | St/nBA copolymer 1 | polyethylene wax 4 | 8 mass parts | 155 | 38 | 7.8 |
| magnetic toner particle 9 | St/nBA copolymer 1 | polyethylene wax 5 | 8 mass parts | 155 | 38 | 7.8 |
| magnetic toner particle 10 | St/nBA copolymer 1 | ester wax (myristyl myristate) | 8 mass parts | 155 | 39 | 7.8 |
| magnetic toner particle 11 | St/nBA copolymer 2 | polyethylene wax 1 | 8 mass parts | 155 | 38 | 7.8 |
| magnetic toner particle 12 | St/nBA copolymer 3 | polyethylene wax 1 | 8 mass parts | 155 | 38 | 7.8 |
| magnetic toner particle 13 | St/nBA copolymer 1 | polyethylene wax 4 | 5 mass parts | 155 | 38 | 7.8 |
| magnetic toner particle 14 | St/nBA copolymer 1 | polyethylene wax 2 | 11 mass parts | 155 | 39 | 7.8 |
| magnetic toner particle 15 | St/nBA copolymer 2 | polyethylene wax 4 | 5 mass parts | 155 | 38 | 7.8 |
| magnetic toner particle 16 | St/nBA copolymer 2 | polyethylene wax 2 | 10 mass parts | 155 | 40 | 7.8 |
| magnetic toner particle 17 | St/nBA copolymer 3 | polyethylene wax 5 | 5 mass parts | 155 | 38 | 7.8 |
| magnetic toner particle 18 | St/nBA copolymer 3 | polyethylene wax 3 | 11 mass parts | 155 | 39 | 7.8 |
| magnetic toner particle 19 | St/nBA copolymer 4 | polyethylene wax 1 | 5 mass parts | 155 | 38 | 7.8 |
| magnetic toner particle 20 | St/nBA copolymer 5 | polyethylene wax 1 | 11 mass parts | 155 | 38 | 7.8 |
| magnetic toner particle 21 | St/nBA copolymer 6 | polyethylene wax 1 | 8 mass parts | 160 | 38 | 7.8 |
| magnetic toner particle 22 | St/nBA copolymer 7 | polyethylene wax 1 | 8 mass parts | 150 | 39 | 7.8 |
| magnetic toner particle 23 | St/nBA copolymer 8 | polyethylene wax 1 | 8 mass parts | 160 | 38 | 7.8 |
| magnetic toner particle 24 | St/nBA copolymer 9 | polyethylene wax 1 | 8 mass parts | 150 | 38 | 7.8 |
| magnetic toner particle 25 | St/nBA copolymer 10 | polyethylene wax 1 | 8 mass parts | 160 | 38 | 7.8 |
| magnetic toner particle 26 | St/nBA copolymer 11 | polyethylene wax 1 | 8 mass parts | 150 | 38 | 7.8 |
| magnetic toner particle 27 | St/nBA copolymer 12 | polyethylene wax 5 | 5 mass parts | 155 | 38 | 7.8 |
| magnetic toner particle 28 | St/nBA copolymer 13 | polyethylene wax 1 | 10 mass parts | 155 | 39 | 7.8 |
| magnetic toner particle 29 | St/nBA copolymer 14 | polyethylene wax 5 | 5 mass parts | 155 | 38 | 7.8 |
| magnetic toner particle 30 | St/nBA copolymer 14 | polyethylene wax 3 | 11 mass parts | 155 | 40 | 7.8 |
| magnetic toner particle 31 | St/nBA copolymer 15 | polyethylene wax 5 | 5 mass parts | 155 | 38 | 7.8 |
| magnetic toner particle 32 | St/nBA copolymer 16 | polyethylene wax 3 | 8 mass parts | 150 | 38 | 7.8 |
| magnetic toner particle 33 | St/nBA copolymer 17 | polyethylene wax 4 | 11 mass parts | 160 | 38 | 7.8 |
| magnetic toner particle 34 | St/nBA copolymer 18 | polyethylene wax 2 | 5 mass parts | 150 | 38 | 7.8 |
| magnetic toner particle 35 | St/nBA copolymer 2 | polyethylene wax 5 | 5 mass parts | 155 | 38 | 7.8 |
| magnetic toner particle 36 | St/nBA copolymer 1 | polyethylene wax 3 | 11 mass parts | 155 | 39 | 7.8 |
| magnetic toner particle 37 | St/nBA copolymer 19 | polyethylene wax 6 | 5 mass parts | 155 | 38 | 7.8 |
| magnetic toner particle 38 | St/nBA copolymer 20 | polyethylene wax 7 | 11 mass parts | 155 | 38 | 7.8 |
| magnetic toner particle 39 | St/nBA copolymer 21 | polyethylene wax 1 | 8 mass parts | 155 | 40 | 7.8 |
| magnetic toner particle 40 | St/nBA copolymer 22 | polyethylene wax 1 | 8 mass parts | 150 | 38 | 7.8 |
| magnetic toner particle 41 | St/nBA copolymer 19 | polyethylene wax 5 | 5 mass parts | 155 | 38 | 7.8 |
| magnetic toner particle 42 | St/nBA copolymer 19 | polyethylene wax 1 | 10 mass parts | 155 | 38 | 7.8 |
| magnetic toner particle 43 | St/nBA copolymer 23 | polyethylene wax 5 | 5 mass parts | 155 | 39 | 7.8 |
| magnetic toner particle 44 | St/nBA copolymer 24 | polyethylene wax 3 | 5 mass parts | 155 | 38 | 7.8 |
| magnetic toner particle 45 | St/nBA copolymer 25 | polyethylene wax 5 | 5 mass parts | 160 | 38 | 7.8 |
| magnetic toner particle 46 | St/nBA copolymer 26 | polyethylene wax 3 | 8 mass parts | 150 | 38 | 7.8 |
| magnetic toner particle 47 | St/nBA copolymer 27 | polyethylene wax 1 | 11 mass parts | 155 | 39 | 7.8 |
| magnetic toner particle 48 | St/nBA copolymer 28 | polyethylene wax 3 | 11 mass parts | 150 | 38 | 7.8 |
| magnetic toner particle 49 | St/nBA copolymer 1 | polyethylene wax 1 | 8 mass parts | 155 | 38 | 7.8 |
| magnetic toner particle 50 | St/nBA copolymer 1 | polyethylene wax 1 | 8 mass parts | 155 | 38 | 7.8 |

<Magnetic Toner Production Example 1>

An external addition and mixing process was carried out using the apparatus shown in FIG. 4 on the magnetic toner particle 1 provided by Magnetic Toner Particle Production Example 1.

In this example, the diameter of the inner circumference of the main casing 1 of the apparatus shown in FIG. 4 was 130 mm; the apparatus used had a volume for the processing space 9 of $2.0\times10^{-3}$ $m^3$; the rated power for the drive member 8 was 5.5 kW; and the stirring member 3 had the shape given in FIG. 5. The overlap width d in FIG. 5 between the stirring member 3*a* and the stirring member 3*b* was 0.25D with respect to the maximum width D of the stirring member 3, and the clearance between the stirring member 3 and the inner circumference of the main casing 1 was 3.0 mm.

100 mass parts of the magnetic toner particles 1 and 2.00 mass parts of the silica fine particles 1 described below were introduced into the apparatus shown in FIG. 4 having the apparatus structure described above.

Silica fine particles 1 were obtained by treating 100 mass parts of a silica with a BET specific surface area of 130 $m^2/g$ and a primary particle number-average particle diameter (D1) of 16 nm with 10 mass parts hexamethyldisilazane and then with 10 mass parts dimethylsilicone oil.

A pre-mixing was carried out after the introduction of the magnetic toner particles and the silica fine particles in order to uniformly mix the magnetic toner particles and the silica fine particles. The pre-mixing conditions were as follows: a drive member 8 power of 0.1 W/g (drive member 8 rotation rate of 150 rpm) and a processing time of 1 minute.

The external addition and mixing process was carried out once pre-mixing was finished. With regard to the conditions for the external addition and mixing process, the processing time was 5 minutes and the peripheral velocity of the outermost end of the stirring member 3 was adjusted to provide a constant drive member 8 power of 1.0 W/g (drive member 8 rotation rate of 1800 rpm). The conditions for the external addition and mixing process are shown in Table 5.

After the external addition and mixing process, the coarse particles and so forth were removed using a circular vibrating screen equipped with a screen having a diameter of 500 mm and an aperture of 75 μm to obtain magnetic toner 1. A value of 18 nm was obtained when magnetic toner 1 was submitted to magnification and observation with a scanning electron microscope and the number-average particle diameter of the primary particles of the silica fine particles on the magnetic toner surface was measured. The external addition conditions and properties of magnetic toner 1 are shown in Table 5 and Table 6, respectively.

<Magnetic Toner Production Example 2>

A magnetic toner 2 was obtained by following the same procedure as in Magnetic Toner Production Example 1, with the exception that silica fine particles 2 were used in place of the silica fine particles 1. Silica fine particles 2 were obtained by performing the same surface treatment as with silica fine particles 1, but on a silica that had a BET specific area of 200 $m^2/g$ and a primary particle number-average particle diameter (D1) of 12 nm.

A value of 14 nm was obtained when magnetic toner 2 was submitted to magnification and observation with a scanning electron microscope and the number-average particle diameter of the primary particles of the silica fine particles on the magnetic toner surface was measured. The external addition conditions and properties of magnetic toner 2 are shown in Table 5 and Table 6.

<Magnetic Toner Production Example 3>

A magnetic toner 3 was obtained by following the same procedure as in Magnetic Toner Production Example 1, with the exception that silica fine particles 3 were used in place of the silica fine particles 1. Silica fine particles 3 were obtained by performing the same surface treatment as with silica fine particles 1, but on a silica that had a BET specific area of 90 $m^2/g$ and a primary particle number-average particle diameter (D1) of 25 nm. A value of 28 nm was obtained when magnetic toner 3 was submitted to magnification and observation with a scanning electron microscope and the number-average particle diameter of the primary particles of the silica fine particles on the magnetic toner surface was measured. The external addition conditions and properties of magnetic toner 3 are shown in Table 5 and Table 6.

<Magnetic Toner Production Example 4>

Magnetic toner 4 was produced by following the same procedure as in Magnetic Toner Production Example 3, but in this case changing the amount of addition of silica fine particle 3 from the 2.00 mass parts in Magnetic Toner Production Example 3 to 1.80 mass parts. The external addition conditions and properties for magnetic toner 4 are given in Tables 5 and 6.

<Magnetic Toner Production Examples 5 to 41, and 44 to 54 and Comparative Magnetic Toner Production Examples 1 to 17, and 19 to 32>

Magnetic toners 5 to 41, and 44 to 54 and comparative magnetic toners 1 to 17, and 19 to 32 were obtained using the magnetic toner particles shown in Table 5 in Magnetic Toner Production Example 1 in place of magnetic toner particle 1 and by performing respective external addition processing using the external addition recipes, external addition apparatuses, and external addition conditions shown in Table 5. The properties of magnetic toners 5 to 41, and 44 to 54 and comparative magnetic toners 1 to 17, and 19 to 32 are shown in Table 6.

Anatase titanium oxide fine particles (BET specific surface area: 80 $m^2/g$, primary particle number-average particle diameter (D1): 15 nm, treated with 12 mass % isobutyltrimethoxysilane) were used for the titania fine particles referenced in Table 5 and alumina fine particles (BET specific surface area: 80 $m^2/g$, primary particle number-average particle diameter (D1): 17 nm, treated with 10 mass % isobutyltrimethoxysilane) were used for the alumina fine particles referenced in Table 5.

Table 5 gives the proportion (mass %) of silica fine particles for the addition of titania fine particles and/or alumina fine particles in addition to silica fine particles.

For magnetic toners 14 and 15 and comparative magnetic toners 11 to 15, pre-mixing was not performed and the external addition and mixing process was carried out immediately after introduction.

The hybridizer referenced in Table 5 is the Hybridizer Model 5 (Nara Machinery Co., Ltd.), and the HENSCHEL mixer referenced in Table 3 is the FM10C (Mitsui Miike Chemical Engineering Machinery Co., Ltd.).

<Magnetic Toner Production Example 42>

The external addition and mixing process was performed according to the following procedure using the same apparatus configuration (apparatus in FIG. 4) as in Magnetic Toner Production Example 1.

As shown in Table 5, the silica fine particle 1 (2.00 mass parts) added in Magnetic Toner Production Example 1 was changed to silica fine particle 1 (1.70 mass parts) and titania fine particles (0.30 mass parts).

First, 100 mass parts of magnetic toner particles 1, 0.70 mass parts of the silica fine particles, and 0.30 mass parts of the titania fine particles were introduced and the same pre-mixing as in Magnetic Toner Production Example 1 was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 1.0 W/g (drive member 8 rotation rate of 1800 rpm), after which the mixing process was temporarily stopped. The supplementary introduction of the remaining silica fine particles (1.00 mass part with reference to 100 mass parts of magnetic toner particle 1) was then performed, followed by again processing for a processing time of 3 minutes while adjusting the peripheral velocity of the outermost end of the stirring member 3 so as to provide a constant drive member 8 power of 1.0 W/g (drive member 8 rotation rate of 1800 rpm), thus providing a total external addition and mixing process time of 5 minutes.

After the external addition and mixing process, the coarse particles and so forth were removed using a circular vibrating screen as in Magnetic Toner Production Example 1 to obtain magnetic toner 42. The external addition conditions for magnetic toner 42 are given in Table 5 and the properties of magnetic toner 42 are given in Table 6.

<Magnetic Toner Production Example 43>

The external addition and mixing process was performed according to the following procedure using the same apparatus configuration (apparatus in FIG. 4) as in Magnetic Toner Production Example 1.

As shown in Table 5, the silica fine particle 1 (2.00 mass parts) added in Magnetic Toner Production Example 1 was changed to silica fine particle 1 (1.70 mass parts) and titania fine particles (0.30 mass parts).

First, 100 mass parts of magnetic toner particles 1 and 1.70 mass parts of the silica fine particles were introduced and the same pre-mixing as in Magnetic Toner Production Example 1 was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 1.0 W/g (drive member 8 rotation rate of 1800 rpm), after which the mixing process was temporarily stopped. The supplementary introduction of the remaining titania fine particles (0.30 mass parts with reference to 100 mass parts of magnetic toner particle 1) was then performed, followed by again processing for a processing time of 3 minutes while adjusting the peripheral velocity of the outermost end of the stirring member 3 so as to provide a constant drive member 8 power of 1.0 W/g (drive member 8 rotation rate of 1800 rpm), thus providing a total external addition and mixing process time of 5 minutes.

After the external addition and mixing process, the coarse particles and so forth were removed using a circular vibrating screen as in Magnetic Toner Production Example 1 to obtain magnetic toner 43. The external addition conditions for magnetic toner 43 are given in Table 5 and the properties of magnetic toner 43 are given in Table 6.

<Comparative Magnetic Toner Production Example 18>

A comparative magnetic toner 18 was obtained by following the same procedure as in Magnetic Toner Production Example 1, with the exception that silica fine particles 4 were used in place of the silica fine particles 1. Silica fine particles 4 were obtained by performing the same surface treatment as with silica fine particles 1, but on a silica that had a BET specific area of 30 $m^2/g$ and a primary particle number-average particle diameter (D1) of 51 nm. A value of 53 nm was obtained when comparative magnetic toner 18 was submitted to magnification and observation with a scanning electron microscope and the number-average particle diameter of the primary particles of the silica fine particles on the magnetic toner surface was measured. The external addition conditions for comparative magnetic toner 18 are shown in Table 5 and the properties of comparative magnetic toner 18 are shown in Table 6.

TABLE 5

| magnetic toner | magnetic toner particle | silica fine particles (mass parts) | | titania fine particles (mass parts) | alumina fine particles (mass parts) | content of silica fine particles (mass %) | content of silica fine particles in the fixed inorganic fine particles (mass %) | external addition apparatus | operating conditions for the external addition apparatus | operating time by the external addition apparatus |
|---|---|---|---|---|---|---|---|---|---|---|
| magnetic toner 1 | magnetic toner particle 1 | silica fine particles 1 | 2.00 | — | — | 100 | 100 | apparatus of FIG. 4 | 1.0 W/g (1800 rpm) | 5 min |
| magnetic toner 2 | magnetic toner particle 1 | silica fine particles 2 | 2.00 | — | — | 100 | 100 | apparatus of FIG. 4 | 1.0 W/g (1800 rpm) | 5 min |
| magnetic toner 3 | magnetic toner particle 1 | silica fine particles 3 | 2.00 | — | — | 100 | 100 | apparatus of FIG. 4 | 1.0 W/g (1800 rpm) | 5 min |
| magnetic toner 4 | magnetic toner particle 1 | silica fine particles 3 | 1.80 | — | — | 100 | 100 | apparatus of FIG. 4 | 1.0 W/g (1800 rpm) | 5 min |
| magnetic toner 5 | magnetic toner particle 2 | silica fine particles 1 | 2.00 | — | — | 100 | 100 | apparatus of FIG. 4 | 1.0 W/g (1800 rpm) | 5 min |
| magnetic toner 6 | magnetic toner particle 3 | silica fine particles 1 | 2.00 | — | — | 100 | 100 | apparatus of FIG. 4 | 1.0 W/g (1800 rpm) | 5 min |
| magnetic toner 7 | magnetic toner particle 4 | silica fine particles 1 | 2.00 | — | — | 100 | 100 | apparatus of FIG. 4 | 1.0 W/g (1800 rpm) | 5 min |
| magnetic toner 8 | magnetic toner particle 5 | silica fine particles 1 | 2.00 | — | — | 100 | 100 | apparatus of FIG. 4 | 1.0 W/g (1800 rpm) | 5 min |
| magnetic toner 9 | magnetic toner particle 6 | silica fine particles 1 | 2.00 | — | — | 100 | 100 | apparatus of FIG. 4 | 1.0 W/g (1800 rpm) | 5 min |
| magnetic toner 10 | magnetic toner particle 7 | silica fine particles 1 | 2.00 | — | — | 100 | 100 | apparatus of FIG. 4 | 1.0 W/g (1800 rpm) | 5 min |
| magnetic toner 11 | magnetic toner particle 8 | silica fine particles 1 | 2.00 | — | — | 100 | 100 | apparatus of FIG. 4 | 1.0 W/g (1800 rpm) | 5 min |
| magnetic toner 12 | magnetic toner particle 9 | silica fine particles 1 | 2.00 | — | — | 100 | 100 | apparatus of FIG. 4 | 1.0 W/g (1800 rpm) | 5 min |
| magnetic toner 13 | magnetic toner particle 10 | silica fine particles 1 | 2.00 | — | — | 100 | 100 | apparatus of FIG. 4 | 1.0 W/g (1800 rpm) | 5 min |
| magnetic toner 14 | magnetic toner particle 1 | silica fine particles 1 | 2.00 | — | — | 100 | 100 | apparatus of FIG. 4 | no pre-mixing 1.0 W/g (1800 rpm) | 5 min |
| magnetic toner 15 | magnetic toner particle 1 | silica fine particles 1 | 2.00 | — | — | 100 | 100 | apparatus of FIG. 4 | no pre-mixing 1.0 W/g (1800 rpm) | 3 min |
| magnetic toner 16 | magnetic toner particle 11 | silica fine particles 1 | 2.00 | — | — | 100 | 100 | apparatus of FIG. 4 | 1.0 W/g (1800 rpm) | 5 min |
| magnetic toner 17 | magnetic toner particle 12 | silica fine particles 1 | 2.00 | — | — | 100 | 100 | apparatus of FIG. 4 | 1.0 W/g (1800 rpm) | 5 min |
| magnetic toner 18 | magnetic toner particle 13 | silica fine particles 1 | 2.00 | — | — | 100 | 100 | apparatus of FIG. 4 | 1.0 W/g (1800 rpm) | 5 min |
| magnetic toner 19 | magnetic toner particle 14 | silica fine particles 1 | 2.00 | — | — | 100 | 100 | apparatus of FIG. 4 | 1.0 W/g (1800 rpm) | 5 min |
| magnetic toner 20 | magnetic toner particle 15 | silica fine particles 1 | 2.00 | — | — | 100 | 100 | apparatus of FIG. 4 | 1.0 W/g (1800 rpm) | 5 min |
| magnetic toner 21 | magnetic toner particle 16 | silica fine particles 1 | 2.00 | — | — | 100 | 100 | apparatus of FIG. 4 | 1.0 W/g (1800 rpm) | 5 min |
| magnetic toner 22 | magnetic toner particle 17 | silica fine particles 1 | 2.00 | — | — | 100 | 100 | apparatus of FIG. 4 | 1.0 W/g (1800 rpm) | 5 min |
| magnetic toner 23 | magnetic toner particle 18 | silica fine particles 1 | 2.00 | — | — | 100 | 100 | apparatus of FIG. 4 | 1.0 W/g (1800 rpm) | 5 min |
| magnetic toner 24 | magnetic toner particle 19 | silica fine particles 1 | 2.00 | — | — | 100 | 100 | apparatus of FIG. 4 | 1.0 W/g (1800 rpm) | 5 min |
| magnetic toner 25 | magnetic toner particle 20 | silica fine particles 1 | 2.00 | — | — | 100 | 100 | apparatus of FIG. 4 | 1.0 W/g (1800 rpm) | 5 min |
| magnetic toner 26 | magnetic toner particle 21 | silica fine particles 1 | 2.00 | — | — | 100 | 100 | apparatus of FIG. 4 | 1.0 W/g (1800 rpm) | 5 min |
| magnetic toner 27 | magnetic toner particle 22 | silica fine particles 1 | 2.00 | — | — | 100 | 100 | apparatus of FIG. 4 | 1.0 W/g (1800 rpm) | 5 min |
| magnetic toner 28 | magnetic toner particle 23 | silica fine particles 1 | 2.00 | — | — | 100 | 100 | apparatus of FIG. 4 | 1.0 W/g (1800 rpm) | 5 min |
| magnetic toner 29 | magnetic toner particle 24 | silica fine particles 1 | 2.00 | — | — | 100 | 100 | apparatus of FIG. 4 | 1.0 W/g (1800 rpm) | 5 min |
| magnetic toner 30 | magnetic toner particle 25 | silica fine particles 1 | 2.00 | — | — | 100 | 100 | apparatus of FIG. 4 | 1.0 W/g (1800 rpm) | 5 min |
| magnetic toner 31 | magnetic toner particle 26 | silica fine particles 1 | 2.00 | — | — | 100 | 100 | apparatus of FIG. 4 | 1.0 W/g (1800 rpm) | 5 min |
| magnetic toner 32 | magnetic toner particle 27 | silica fine particles 1 | 2.00 | — | — | 100 | 100 | apparatus of FIG. 4 | 1.0 W/g (1800 rpm) | 5 min |
| magnetic toner 33 | magnetic toner particle 28 | silica fine particles 1 | 2.00 | — | — | 100 | 100 | apparatus of FIG. 4 | 1.0 W/g (1800 rpm) | 5 min |
| magnetic toner 34 | magnetic toner particle 29 | silica fine particles 1 | 2.00 | — | — | 100 | 100 | apparatus of FIG. 4 | 1.0 W/g (1800 rpm) | 5 min |
| magnetic toner 35 | magnetic toner particle 30 | silica fine particles 1 | 2.00 | — | — | 100 | 100 | apparatus of FIG. 4 | 1.0 W/g (1800 rpm) | 5 min |
| magnetic toner 36 | magnetic toner particle 31 | silica fine particles 1 | 2.00 | — | — | 100 | 100 | apparatus of FIG. 4 | 1.0 W/g (1800 rpm) | 5 min |
| magnetic toner 37 | magnetic toner particle 32 | silica fine particles 1 | 2.00 | — | — | 100 | 100 | apparatus of FIG. 4 | 1.0 W/g (1800 rpm) | 5 min |
| magnetic toner 38 | magnetic toner particle 33 | silica fine particles 1 | 2.00 | — | — | 100 | 100 | apparatus of FIG. 4 | 1.0 W/g (1800 rpm) | 5 min |
| magnetic toner 39 | magnetic toner particle 34 | silica fine particles 1 | 2.00 | — | — | 100 | 100 | apparatus of FIG. 4 | 1.0 W/g (1800 rpm) | 5 min |
| magnetic toner 40 | magnetic toner particle 1 | silica fine particles 1 | 1.70 | 0.30 | — | 85 | 85 | apparatus of FIG. 4 | 1.0 W/g (1800 rpm) | 5 min |
| magnetic toner 41 | magnetic toner particle 1 | silica fine particles 1 | 1.70 | 0.15 | 0.15 | 85 | 85 | apparatus of FIG. 4 | 1.0 W/g (1800 rpm) | 5 min |
| magnetic toner 42 | magnetic toner particle 1 | silica fine particles 1 | 1.70 | 0.30 | — | 85 | 80 | apparatus of FIG. 4 | 1.0 W/g (1800 rpm) | 5 min |
| magnetic toner 43 | magnetic toner particle 1 | silica fine particles 1 | 1.70 | 0.30 | — | 85 | 90 | apparatus of FIG. 4 | 1.0 W/g (1800 rpm) | 5 min |

TABLE 5-continued

| magnetic toner | magnetic toner particle | silica fine particles (mass parts) | | titania fine particles (mass parts) | alumina fine particles (mass parts) | content of silica fine particles (mass %) | content of silica fine particles in the fixed inorganic fine particles (mass %) | external addition apparatus | operating conditions for the external addition apparatus | operating time by the external addition apparatus |
|---|---|---|---|---|---|---|---|---|---|---|
| magnetic toner 44 | magnetic toner particle 1 | silica fine particles 1 | 1.50 | — | — | 100 | 100 | apparatus of FIG. 4 | 1.0 W/g (1800 rpm) | 5 min |
| magnetic toner 45 | magnetic toner particle 1 | silica fine particles 1 | 1.80 | — | — | 100 | 100 | apparatus of FIG. 4 | 1.0 W/g (1800 rpm) | 5 min |
| magnetic toner 45 | magnetic toner particle 1 | silica fine particles 1 | 1.28 | 0.22 | — | 85 | 85 | apparatus of FIG. 4 | 1.0 W/g (1800 rpm) | 5 min |
| magnetic toner 47 | magnetic toner particle 1 | silica fine particles 1 | 1.28 | 0.12 | 0.10 | 85 | 85 | apparatus of FIG. 4 | 1.0 W/g (1800 rpm) | 5 min |
| magnetic toner 48 | magnetic toner particle 1 | silica fine particles 1 | 2.60 | — | — | 100 | 100 | apparatus of FIG. 4 | 1.0 W/g (1800 rpm) | 5 min |
| magnetic toner 49 | magnetic toner particle 1 | silica fine particles 1 | 2.25 | 0.35 | — | 86 | 86 | apparatus of FIG. 4 | 1.0 W/g (1800 rpm) | 5 min |
| magnetic toner 50 | magnetic toner particle 1 | silica fine particles 1 | 2.25 | 0.20 | 0.15 | 86 | 86 | apparatus of FIG. 4 | 1.0 W/g (1800 rpm) | 5 min |
| magnetic toner 51 | magnetic toner particle 1 | silica fine particles 1 | 1.50 | — | — | 100 | 100 | apparatus of FIG. 4 | 1.6 W/g (2500 rpm) | 5 min |
| magnetic toner 52 | magnetic toner particle 1 | silica fine particles 1 | 1.50 | — | — | 100 | 100 | apparatus of FIG. 4 | 0.6 W/g (1400 rpm) | 5 min |
| magnetic toner 53 | magnetic toner particle 1 | silica fine particles 1 | 2.60 | — | — | 100 | 100 | apparatus of FIG. 4 | 1.6 W/g (2500 rpm) | 5 min |
| magnetic toner 54 | magnetic toner particle 1 | silica fine particles 1 | 2.60 | — | — | 100 | 100 | apparatus of FIG. 4 | 0.6 W/g (1400 rpm) | 5 min |
| comparative magnetic toner 1 | magnetic toner particle 1 | silica fine particles 1 | 1.50 | — | — | 100 | 100 | Henschel mixer | 3000 rpm | 2 min |
| comparative magnetic toner 2 | magnetic toner particle 1 | silica fine particles 1 | 1.50 | — | — | 100 | 100 | Henschel mixer | 4000 rpm | 5 min |
| comparative magnetic toner 3 | magnetic toner particle 1 | silica fine particles 1 | 2.60 | — | — | 100 | 100 | Henschel mixer | 3000 rpm | 2 min |
| comparative magnetic toner 4 | magnetic toner particle 1 | silica fine particles 1 | 2.60 | — | — | 100 | 100 | Henschel mixer | 4000 rpm | 5 min |
| comparative magnetic toner 5 | magnetic toner particle 1 | silica fine particles 1 | 1.50 | — | — | 100 | 100 | hybridzer | 7000 rpm | 8 min |
| comparative magnetic toner 6 | magnetic toner particle 1 | silica fine particles 1 | 1.50 | — | — | 100 | 100 | hybridzer | 7000 rpm | 8 min |
| comparative magnetic toner 7 | magnetic toner particle 49 | silica fine particles 1 | 1.00 | — | — | 100 | 100 | Henschel mixer | 4000 rpm | 2 min |
| comparative magnetic toner 8 | magnetic toner particle 49 | silica fine particles 1 | 2.00 | — | — | 100 | 100 | Henschel mixer | 4000 rpm | 2 min |
| comparative magnetic toner 9 | magnetic toner particle 50 | silica fine particles 1 | 1.00 | — | — | 100 | 100 | Henschel mixer | 4000 rpm | 2 min |
| comparative magnetic toner 10 | magnetic toner particle 50 | silica fine particles 1 | 2.00 | — | — | 100 | 100 | Henschel mixer | 4000 rpm | 2 min |
| comparative magnetic toner 11 | magnetic toner particle 1 | silica fine particles 1 | 1.50 | — | — | 100 | 100 | apparatus of FIG. 4 | no pre-mixing 0.6 W/g (1400 rpm) | 3 min |
| comparative magnetic toner 12 | magnetic toner particle 1 | silica fine particles 1 | 1.20 | — | — | 100 | 100 | apparatus of FIG. 4 | no pre-mixing 0.6 W/g (1400 rpm) | 3 min |
| comparative magnetic toner 13 | magnetic toner particle 1 | silica fine particles 1 | 3.10 | — | — | 100 | 100 | apparatus of FIG. 4 | no pre-mixing 1.6 W/g (2500 rpm) | 3 min |
| comparative magnetic toner 14 | magnetic toner particle 1 | silica fine particles 1 | 2.60 | — | — | 100 | 100 | apparatus of FIG. 4 | no pre-mixing 0.6 W/g (1400 rpm) | 3 min |
| comparative magnetic toner 15 | magnetic toner particle 1 | silica fine particles 1 | 1.50 | — | — | 100 | 100 | apparatus of FIG. 4 | no pre-mixing 2.2 W/g (3300 rpm) | 5 min |
| comparative magnetic toner 16 | magnetic toner particle 1 | silica fine particles 1 | 1.60 | 0.40 | — | 80 | 80 | apparatus of FIG. 4 | 1.0 W/g (1800 rpm) | 5 min |
| comparative magnetic toner 17 | magnetic toner particle 1 | silica fine particles 1 | 1.60 | 0.20 | 0.20 | 80 | 80 | apparatus of FIG. 4 | 1.0 W/g (1800 rpm) | 5 min |
| comparative magnetic toner 18 | magnetic toner particle 1 | silica fine particles 4 | 2.00 | — | — | 100 | 100 | apparatus of FIG. 4 | 1.0 W/g (1800 rpm) | 5 min |

TABLE 5-continued

| magnetic toner | magnetic toner particle | silica fine particles (mass parts) | | titania fine particles (mass parts) | alumina fine particles (mass parts) | content of silica fine particles (mass %) | content of silica fine particles in the fixed inorganic fine particles (mass %) | external addition apparatus | operating conditions for the external addition apparatus | operating time by the external addition apparatus |
|---|---|---|---|---|---|---|---|---|---|---|
| comparative magnetic toner 19 | magnetic toner particle 35 | silica fine particles 1 | 2.00 | — | — | 100 | 100 | apparatus of FIG. 4 | 1.0 W/g (1800 rpm) | 5 min |
| comparative magnetic toner 20 | magnetic toner particle 36 | silica fine particles 1 | 2.00 | — | — | 100 | 100 | apparatus of FIG. 4 | 1.0 W/g (1800 rpm) | 5 min |
| comparative magnetic toner 21 | magnetic toner particle 37 | silica fine particles 1 | 2.00 | — | — | 100 | 100 | apparatus of FIG. 4 | 1.0 W/g (1800 rpm) | 5 min |
| comparative magnetic toner 22 | magnetic toner particle 38 | silica fine particles 1 | 2.00 | — | — | 100 | 100 | apparatus of FIG. 4 | 1.0 W/g (1800 rpm) | 5 min |
| comparative magnetic toner 23 | magnetic toner particle 39 | silica fine particles 1 | 2.00 | — | — | 100 | 100 | apparatus of FIG. 4 | 1.0 W/g (1800 rpm) | 5 min |
| comparative magnetic toner 24 | magnetic toner particle 40 | silica fine particles 1 | 2.00 | — | — | 100 | 100 | apparatus of FIG. 4 | 1.0 W/g (1800 rpm) | 5 min |
| comparative magnetic toner 25 | magnetic toner particle 41 | silica fine particles 1 | 2.00 | — | — | 100 | 100 | apparatus of FIG. 4 | 1.0 W/g (1800 rpm) | 5 min |
| comparative magnetic toner 26 | magnetic toner particle 42 | silica fine particles 1 | 2.00 | — | — | 100 | 100 | apparatus of FIG. 4 | 1.0 W/g (1800 rpm) | 5 min |
| comparative magnetic toner 27 | magnetic toner particle 43 | silica fine particles 1 | 2.00 | — | — | 100 | 100 | apparatus of FIG. 4 | 1.0 W/g (1800 rpm) | 5 min |
| comparative magnetic toner 28 | magnetic toner particle 44 | silica fine particles 1 | 2.00 | — | — | 100 | 100 | apparatus of FIG. 4 | 1.0 W/g (1800 rpm) | 5 min |
| comparative magnetic toner 29 | magnetic toner particle 45 | silica fine particles 1 | 2.00 | — | — | 100 | 100 | apparatus of FIG. 4 | 1.0 W/g (1800 rpm) | 5 min |
| comparative magnetic toner 30 | magnetic toner particle 46 | silica fine particles 1 | 2.00 | — | — | 100 | 100 | apparatus of FIG. 4 | 1.0 W/g (1800 rpm) | 5 min |
| comparative magnetic toner 31 | magnetic toner particle 47 | silica fine particles 1 | 2.00 | — | — | 100 | 100 | apparatus of FIG. 4 | 1.0 W/g (1800 rpm) | 5 min |
| comparative magnetic toner 32 | magnetic toner particle 48 | silica fine particles 1 | 2.00 | — | — | 100 | 100 | apparatus of FIG. 4 | 1.0 W/g (1800 rpm) | 5 min |

TABLE 6

| magnetic toner | magnetic toner particle | weight-average particle diameter D4 (μm) | average circularity (—) | coverage ratio A (%) | B/A (—) | coefficient of variation on the coverage ratio A (%) | weight-average molecular weight by SEC-MALLS (Mw) | (Rw/Mw) by SEC-MALLS ($\times 10^{-3}$) | viscosity at 110° C. (Pa · s) |
|---|---|---|---|---|---|---|---|---|---|
| magnetic toner 1 | magnetic toner particle 1 | 7.8 | 0.943 | 55.5 | 0.70 | 6.5 | 10000 | 5.5 | 15000 |
| magnetic toner 2 | magnetic toner particle 1 | 7.8 | 0.943 | 58.0 | 0.73 | 6.0 | 10000 | 5.5 | 15000 |
| magnetic toner 3 | magnetic toner particle 1 | 7.8 | 0.943 | 50.0 | 0.65 | 9.0 | 10000 | 5.5 | 15000 |
| magnetic toner 4 | magnetic toner particle 1 | 7.8 | 0.943 | 47.0 | 0.64 | 8.5 | 10000 | 5.5 | 15000 |
| magnetic toner 5 | magnetic toner particle 2 | 7.8 | 0.945 | 55.2 | 0.70 | 6.6 | 10000 | 5.5 | 14000 |
| magnetic toner 6 | magnetic toner particle 3 | 7.8 | 0.944 | 55.4 | 0.69 | 6.5 | 9500 | 5.4 | 13000 |
| magnetic toner 7 | magnetic toner particle 4 | 7.8 | 0.943 | 55.6 | 0.71 | 6.6 | 9500 | 5.4 | 16000 |
| magnetic toner 8 | magnetic toner particle 5 | 7.8 | 0.947 | 55.0 | 0.71 | 6.4 | 10500 | 5.6 | 17000 |
| magnetic toner 9 | magnetic toner particle 6 | 7.8 | 0.944 | 55.8 | 0.72 | 6.5 | 10000 | 5.5 | 13000 |
| magnetic toner 10 | magnetic toner particle 7 | 7.8 | 0.946 | 55.0 | 0.69 | 6.6 | 10000 | 5.4 | 11000 |
| magnetic toner 11 | magnetic toner particle 8 | 7.8 | 0.942 | 55.7 | 0.71 | 6.6 | 11000 | 5.5 | 18000 |
| magnetic toner 12 | magnetic toner particle 9 | 7.8 | 0.945 | 55.6 | 0.71 | 6.6 | 9000 | 5.4 | 20000 |
| magnetic toner 13 | magnetic toner particle 10 | 7.8 | 0.943 | 55.4 | 0.71 | 6.5 | 10500 | 5.6 | 12000 |
| magnetic toner 14 | magnetic toner particle 1 | 7.8 | 0.943 | 52.4 | 0.72 | 9.8 | 10000 | 5.5 | 15000 |
| magnetic toner 15 | magnetic toner particle 1 | 7.8 | 0.943 | 51.6 | 0.66 | 10.5 | 10000 | 5.4 | 15000 |
| magnetic toner 16 | magnetic toner particle 11 | 7.8 | 0.947 | 55.2 | 0.70 | 6.4 | 10500 | 5.0 | 17000 |
| magnetic toner 17 | magnetic toner particle 12 | 7.8 | 0.946 | 55.8 | 0.71 | 6.5 | 10500 | 4.8 | 18000 |
| magnetic toner 18 | magnetic toner particle 13 | 7.8 | 0.944 | 55.9 | 0.69 | 6.6 | 9500 | 5.4 | 25000 |
| magnetic toner 19 | magnetic toner particle 14 | 7.8 | 0.946 | 55.4 | 0.69 | 6.4 | 9000 | 5.6 | 5000 |
| magnetic toner 20 | magnetic toner particle 15 | 7.8 | 0.945 | 55.7 | 0.71 | 6.5 | 11000 | 5.0 | 25000 |
| magnetic toner 21 | magnetic toner particle 16 | 7.8 | 0.947 | 55.8 | 0.70 | 6.4 | 10000 | 5.0 | 5000 |
| magnetic toner 22 | magnetic toner particle 17 | 7.8 | 0.950 | 55.7 | 0.71 | 6.6 | 10500 | 4.8 | 25000 |
| magnetic toner 23 | magnetic toner particle 18 | 7.8 | 0.948 | 55.3 | 0.69 | 6.6 | 10500 | 4.8 | 5000 |
| magnetic toner 24 | magnetic toner particle 19 | 7.8 | 0.945 | 55.4 | 0.69 | 6.4 | 9500 | 6.5 | 15000 |
| magnetic toner 25 | magnetic toner particle 20 | 7.8 | 0.943 | 55.4 | 0.71 | 6.5 | 10500 | 3.0 | 15000 |
| magnetic toner 26 | magnetic toner particle 21 | 7.8 | 0.943 | 55.8 | 0.72 | 6.6 | 5000 | 5.4 | 8000 |
| magnetic toner 27 | magnetic toner particle 22 | 7.8 | 0.945 | 55.7 | 0.69 | 6.6 | 19500 | 5.4 | 20000 |
| magnetic toner 28 | magnetic toner particle 23 | 7.8 | 0.946 | 55.2 | 0.71 | 6.5 | 5500 | 5.0 | 10000 |
| magnetic toner 29 | magnetic toner particle 24 | 7.8 | 0.948 | 55.6 | 0.71 | 6.4 | 20000 | 5.0 | 21000 |
| magnetic toner 30 | magnetic toner particle 25 | 7.8 | 0.946 | 55.4 | 0.71 | 6.4 | 5500 | 4.8 | 11000 |
| magnetic toner 31 | magnetic toner particle 26 | 7.8 | 0.944 | 55.8 | 0.69 | 6.6 | 19500 | 4.8 | 23000 |
| magnetic toner 32 | magnetic toner particle 27 | 7.8 | 0.947 | 55.4 | 0.71 | 6.6 | 12000 | 6.5 | 25000 |
| magnetic toner 33 | magnetic toner particle 28 | 7.8 | 0.946 | 55.2 | 0.70 | 6.5 | 10500 | 6.5 | 5000 |
| magnetic toner 34 | magnetic toner particle 29 | 7.8 | 0.947 | 55.3 | 0.70 | 6.4 | 8500 | 3.0 | 25000 |
| magnetic toner 35 | magnetic toner particle 30 | 7.8 | 0.946 | 55.5 | 0.69 | 6.6 | 8000 | 3.0 | 5000 |
| magnetic toner 36 | magnetic toner particle 31 | 7.8 | 0.947 | 55.6 | 0.69 | 6.5 | 5500 | 6.5 | 15000 |
| magnetic toner 37 | magnetic toner particle 32 | 7.8 | 0.945 | 55.8 | 0.71 | 6.5 | 19500 | 6.5 | 15000 |
| magnetic toner 38 | magnetic toner particle 33 | 7.8 | 0.942 | 55.7 | 0.70 | 6.4 | 5000 | 3.0 | 15000 |
| magnetic toner 39 | magnetic toner particle 34 | 7.8 | 0.948 | 55.6 | 0.70 | 6.5 | 20000 | 3.1 | 15000 |
| magnetic toner 40 | magnetic toner particle 1 | 7.8 | 0.943 | 54.8 | 0.68 | 6.8 | 10000 | 5.5 | 15000 |
| magnetic toner 41 | magnetic toner particle 1 | 7.8 | 0.943 | 54.3 | 0.67 | 6.8 | 10000 | 5.5 | 15000 |
| magnetic toner 42 | magnetic toner particle 1 | 7.8 | 0.943 | 54.2 | 0.66 | 6.8 | 10000 | 5.5 | 15000 |
| magnetic toner 43 | magnetic toner particle 1 | 7.8 | 0.943 | 54.9 | 0.69 | 6.8 | 10000 | 5.5 | 15000 |
| magnetic toner 44 | magnetic toner particle 1 | 7.8 | 0.943 | 45.8 | 0.72 | 6.7 | 10000 | 5.5 | 15000 |
| magnetic toner 45 | magnetic toner particle 1 | 7.8 | 0.943 | 49.0 | 0.71 | 6.6 | 10000 | 5.5 | 15000 |
| magnetic toner 46 | magnetic toner particle 1 | 7.8 | 0.943 | 45.5 | 0.71 | 6.8 | 10000 | 5.5 | 15000 |
| magnetic toner 47 | magnetic toner particle 1 | 7.8 | 0.943 | 45.4 | 0.71 | 6.9 | 10000 | 5.5 | 15000 |
| magnetic toner 48 | magnetic toner particle 1 | 7.8 | 0.943 | 69.2 | 0.69 | 6.3 | 10000 | 5.5 | 15000 |
| magnetic toner 49 | magnetic toner particle 1 | 7.8 | 0.943 | 68.7 | 0.70 | 6.4 | 10000 | 5.5 | 15000 |
| magnetic toner 50 | magnetic toner particle 1 | 7.8 | 0.943 | 67.8 | 0.67 | 6.6 | 10000 | 5.5 | 15000 |
| magnetic toner 51 | magnetic toner particle 1 | 7.8 | 0.943 | 45.8 | 0.84 | 6.3 | 10000 | 5.5 | 15000 |
| magnetic toner 52 | magnetic toner particle 1 | 7.8 | 0.943 | 45.8 | 0.52 | 7.1 | 10000 | 5.5 | 15000 |
| magnetic toner 53 | magnetic toner particle 1 | 7.8 | 0.943 | 69.2 | 0.83 | 5.9 | 10000 | 5.5 | 15000 |
| magnetic toner 54 | magnetic toner particle 1 | 7.8 | 0.943 | 69.2 | 0.52 | 6.7 | 10000 | 5.5 | 15000 |
| comparative magnetic toner 1 | magnetic toner particle 1 | 7.8 | 0.943 | 36.5 | 0.41 | 18.0 | 10000 | 5.5 | 15000 |
| comparative magnetic toner 2 | magnetic toner particle 1 | 7.8 | 0.943 | 38.2 | 0.43 | 18.0 | 10000 | 5.5 | 15000 |
| comparative magnetic toner 3 | magnetic toner particle 1 | 7.8 | 0.943 | 50.2 | 0.35 | 13.2 | 10000 | 5.5 | 15000 |
| comparative magnetic toner 4 | magnetic toner particle 1 | 7.8 | 0.943 | 52.4 | 0.36 | 12.1 | 10000 | 5.5 | 15000 |
| comparative magnetic toner 5 | magnetic toner particle 1 | 7.8 | 0.943 | 43.5 | 0.82 | 13.5 | 10000 | 5.5 | 15000 |
| comparative magnetic toner 6 | magnetic toner particle 1 | 7.8 | 0.943 | 44.5 | 0.86 | 12.5 | 10000 | 5.5 | 15000 |
| comparative magnetic toner 7 | magnetic toner particle 49 | 7.8 | 0.970 | 42.8 | 0.47 | 14.8 | 9500 | 5.4 | 15000 |
| comparative magnetic toner 8 | magnetic toner particle 49 | 7.8 | 0.970 | 54.8 | 0.48 | 14.9 | 9500 | 5.4 | 15000 |
| comparative magnetic toner 9 | magnetic toner particle 50 | 7.8 | 0.972 | 63.2 | 0.87 | 13.2 | 10500 | 5.5 | 15000 |
| comparative | magnetic toner particle 50 | 7.8 | 0.972 | 71.5 | 0.83 | 13.1 | 10500 | 5.5 | 15000 |

TABLE 6-continued

| magnetic toner | magnetic toner particle | weight-average particle diameter D4 (μm) | average circularity (—) | coverage ratio A (%) | B/A (—) | coefficient of variation on the coverage ratio A (%) | weight-average molecular weight by SEC-MALLS (Mw) | (Rw/Mw) by SEC-MALLS ($\times 10^{-3}$) | viscosity at 110° C. (Pa · s) |
|---|---|---|---|---|---|---|---|---|---|
| magnetic toner 10 comparative | magnetic toner particle 1 | 7.8 | 0.943 | 45.8 | 0.48 | 12.5 | 10000 | 5.5 | 15000 |
| magnetic toner 11 comparative | magnetic toner particle 1 | 7.8 | 0.943 | 43.2 | 0.53 | 13.0 | 10000 | 5.5 | 15000 |
| magnetic toner 12 comparative | magnetic toner particle 1 | 7.8 | 0.943 | 72.5 | 0.54 | 11.5 | 10000 | 5.5 | 15000 |
| magnetic toner 13 comparative | magnetic toner particle 1 | 7.8 | 0.943 | 68.2 | 0.48 | 11.9 | 10000 | 5.5 | 15000 |
| magnetic toner 14 comparative | magnetic toner particle 1 | 7.8 | 0.943 | 46.7 | 0.88 | 11.8 | 10000 | 5.5 | 15000 |
| magnetic toner 15 comparative | magnetic toner particle 1 | 7.8 | 0.943 | 54.0 | 0.68 | 8.0 | 10000 | 5.5 | 15000 |
| magnetic toner 16 comparative | magnetic toner particle 1 | 7.8 | 0.943 | 53.5 | 0.66 | 8.5 | 10000 | 5.5 | 15000 |
| magnetic toner 17 comparative | magnetic toner particle 1 | 7.8 | 0.943 | 36.0 | 0.50 | 11.0 | 10000 | 5.5 | 15000 |
| magnetic toner 18 comparative | magnetic toner particle 35 | 7.8 | 0.943 | 55.8 | 0.71 | 6.4 | 9000 | 5.0 | 26000 |
| magnetic toner 19 comparative | magnetic toner particle 36 | 7.8 | 0.945 | 55.6 | 0.71 | 6.6 | 9500 | 5.5 | 4500 |
| magnetic toner 20 comparative | magnetic toner particle 37 | 7.8 | 0.944 | 55.4 | 0.70 | 6.5 | 10500 | 6.7 | 15000 |
| magnetic toner 21 comparative | magnetic toner particle 38 | 7.8 | 0.945 | 55.7 | 0.69 | 6.5 | 11000 | 2.8 | 15000 |
| magnetic toner 22 comparative | magnetic toner particle 39 | 7.8 | 0.946 | 55.8 | 0.69 | 6.6 | 4800 | 5.5 | 7000 |
| magnetic toner 23 comparative | magnetic toner particle 40 | 7.8 | 0.942 | 55.4 | 0.70 | 6.6 | 22000 | 5.5 | 23000 |
| magnetic toner 24 comparative | magnetic toner particle 41 | 7.8 | 0.948 | 55.3 | 0.69 | 6.5 | 11000 | 6.7 | 26000 |
| magnetic toner 25 comparative | magnetic toner particle 42 | 7.8 | 0.945 | 55.1 | 0.71 | 6.4 | 10500 | 6.7 | 4800 |
| magnetic toner 26 comparative | magnetic toner particle 43 | 7.8 | 0.946 | 55.6 | 0.70 | 6.5 | 8000 | 2.8 | 26000 |
| magnetic toner 27 comparative | magnetic toner particle 44 | 7.8 | 0.945 | 55.6 | 0.69 | 6.6 | 7000 | 2.8 | 4800 |
| magnetic toner 28 comparative | magnetic toner particle 45 | 7.8 | 0.943 | 55.7 | 0.71 | 6.4 | 4800 | 6.7 | 13000 |
| magnetic toner 29 comparative | magnetic toner particle 46 | 7.8 | 0.944 | 55.8 | 0.69 | 6.4 | 22500 | 6.7 | 16000 |
| magnetic toner 30 comparative | magnetic toner particle 47 | 7.8 | 0.943 | 55.2 | 0.70 | 6.6 | 4800 | 2.8 | 15000 |
| magnetic toner 31 comparative | magnetic toner particle 48 | 7.8 | 0.949 | 55.8 | 0.71 | 6.5 | 21500 | 2.8 | 17000 |
| magnetic toner 32 | | | | | | | | | |

Example 1

The Image-Forming Apparatus

The image-forming apparatus was an LBP-3300 (Canon, Inc.) in which the printing speed had been modified from 21 sheets/minute to 25 sheets/minute.

Using this modified apparatus and magnetic toner 1, a 4000-sheet image printing test was performed in one-sheet intermittent mode of horizontal lines at a print percentage of 1% in a normal-temperature, normal-humidity environment (25° C./50% RH). 80 g/m$^2$ A4 paper was used as the recording medium.

According to the results, a high density was obtained before and after the durability test and a stable image could be obtained. The results of the evaluation are shown in Table 7.

In addition, using magnetic toner 1 and the same image-forming apparatus that had been modified to enable adjustment of the fixation temperature in the fixing unit, the offset property was evaluated using 90 g/m$^2$ A4 paper in a normal-temperature, normal-humidity environment (temperature=25° C., humidity=50% RH). According to the results, cold offset had still not appeared to below 180° C. and the cold offset property was thus excellent. The results are given in Table 7.

The offset property was also evaluated using 90 g/m$^2$ A4 paper in a low-temperature, low-humidity environment (temperature=15° C., humidity=10% RH). According to the results, cold offset had still not appeared to below 180° C. and the cold offset property was thus excellent. The results are given in Table 7.

The evaluation methods and associated scales used in the evaluations carried out in the examples of the present invention and comparative examples are described below.

<Image Density>

For the image density, a solid image area was formed and the density of this solid image was measured with a MacBeth reflection densitometer (MacBeth Corporation).

The following scale was used to score the reflection density of the solid image at the start of the durability test (evaluation 1) and after 4000 sheets had been printed (evaluation 2).

A: very good (greater than or equal to 1.46)
B: good (less than or equal to 1.45 and greater than or equal to 1.41) (not problematic from a practical standpoint)
C: average (less than or equal to 1.40 and greater than or equal to 1.36) (not preferred, but an acceptable level from a practical standpoint)
D: poor (less than or equal to 1.35)

<Cold Offset>

The developing bias was set so that the image density of a halftone image, measured with a MacBeth reflection densitometer (MacBeth Corporation), was 0.80 to 0.85. Then, the fixing unit was cooled to room temperature (25° C. or 15° C.); the heater temperature in the fixing unit was randomly set into the range from greater than or equal to 160° C. to less than or equal to 230° C. (referred to below as the fixation temperature); and power was supplied and the image was fed after 6 seconds and fixing was carried out. The cold offset was evaluated by visual inspection using the following scale.

A: cold offset has still not appeared to 180° C.
B: cold offset appears at from greater than or equal to 180° C. to less than 190° C. (not problematic from a practical standpoint)
C: cold offset appears at from greater than or equal to 190° C. to less than 200° C. (not preferred, but an acceptable level from a practical standpoint)
D: cold offset appears at greater than or equal to 200° C.

Examples 2 to 54 and Comparative Examples 1 to 32

Toner evaluations were carried out under the same conditions as in Example 1 using magnetic toners 2 to 54 and comparative magnetic toners 1 to 32 for the magnetic toner. The results of the evaluations are shown in Table 7. In the comparative magnetic toners, images that pose practical problems were obtained in terms of image density and/or offset resistance.

TABLE 7

| | | evaluation 1 (initial density) | evaluation 2 (after 4000 prints) | evaluation 3 (cold offset at normal temperature and normal humidity) | evaluation 4 (cold offset at low temperature and low humidity) |
|---|---|---|---|---|---|
| Example 1 | magnetic toner 1 | A(1.52) | A(1.50) | A | A |
| Example 2 | magnetic toner 2 | A(1.52) | A(1.48) | A | A |
| Example 3 | magnetic toner 3 | A(1.50) | A(1.49) | A | A |
| Example 4 | magnetic toner 4 | A(1.48) | A(1.46) | A | A |
| Example 5 | magnetic toner 5 | A(1.50) | B(1.45) | A | A |
| Example 6 | magnetic toner 6 | A(1.48) | B(1.45) | B | A |
| Example 7 | magnetic toner 7 | A(1.52) | A(1.49) | A | B |
| Example 8 | magnetic toner 8 | A(1.50) | A(1.47) | B | B |
| Example 9 | magnetic toner 9 | A(1.50) | B(1.44) | A | A |
| Example 10 | magnetic toner 10 | A(1.48) | B(1.43) | B | A |
| Example 11 | magnetic toner 11 | A(1.51) | A(1.48) | A | B |
| Example 12 | magnetic toner 12 | A(1.50) | A(1.47) | B | B |
| Example 13 | magnetic toner 13 | A(1.51) | A(1.46) | B | C |
| Example 14 | magnetic toner 14 | A(1.51) | A(1.46) | A | B |
| Example 15 | magnetic toner 15 | A(1.48) | B(1.45) | B | B |
| Example 16 | magnetic toner 16 | A(1.50) | A(1.47) | A | B |
| Example 17 | magnetic toner 17 | A(1.50) | A(1.47) | B | B |
| Example 18 | magnetic toner 18 | A(1.48) | A(1.46) | B | B |
| Example 19 | magnetic toner 19 | A(1.48) | B(1.41) | B | B |
| Example 20 | magnetic toner 20 | A(1.48) | A(1.46) | B | B |
| Example 21 | magnetic toner 21 | B(1.44) | B(1.41) | B | B |
| Example 22 | magnetic toner 22 | A(1.48) | A(1.46) | B | B |
| Example 23 | magnetic toner 23 | B(1.45) | B(1.41) | B | B |
| Example 24 | magnetic toner 24 | A(1.50) | A(1.47) | A | B |
| Example 25 | magnetic toner 25 | A(1.50) | A(1.47) | B | B |
| Example 26 | magnetic toner 26 | A(1.48) | B(1.41) | A | A |
| Example 27 | magnetic toner 27 | A(1.50) | A(1.47) | A | B |
| Example 28 | magnetic toner 28 | A(1.48) | B(1.41) | B | A |
| Example 29 | magnetic toner 29 | A(1.52) | A(1.49) | B | B |
| Example 30 | magnetic toner 30 | A(1.48) | B(1.41) | B | B |
| Example 31 | magnetic toner 31 | A(1.52) | A(1.49) | B | B |
| Example 32 | magnetic toner 32 | A(1.52) | A(1.49) | B | B |
| Example 33 | magnetic toner 33 | A(1.48) | B(1.41) | B | B |
| Example 34 | magnetic toner 34 | A(1.50) | A(1.47) | C | C |
| Example 35 | magnetic toner 35 | B(1.45) | C(1.38) | B | B |
| Example 36 | magnetic toner 36 | B(1.45) | B(1.41) | B | B |
| Example 37 | magnetic toner 37 | A(1.48) | B(1.43) | B | B |
| Example 38 | magnetic toner 38 | B(1.45) | B(1.41) | B | B |
| Example 39 | magnetic toner 39 | A(1.52) | A(1.50) | C | C |
| Example 40 | magnetic toner 40 | A(1.48) | B(1.43) | A | A |
| Example 41 | magnetic toner 41 | B(1.45) | B(1.41) | A | A |
| Example 42 | magnetic toner 42 | A(1.46) | B(1.41) | A | A |
| Example 43 | magnetic toner 43 | A(1.48) | B(1.43) | A | A |
| Example 44 | magnetic toner 44 | B(1.43) | C(1.40) | A | B |
| Example 45 | magnetic toner 45 | B(1.45) | B(1.43) | A | B |
| Example 46 | magnetic toner 46 | B(1.44) | B(1.41) | A | B |
| Example 47 | magnetic toner 47 | B(1.43) | C(1.36) | A | B |
| Example 48 | magnetic toner 48 | A(1.50) | A(1.47) | B | C |
| Example 49 | magnetic toner 49 | A(1.48) | B(1.43) | B | C |
| Example 50 | magnetic toner 50 | B(1.45) | B(1.41) | B | C |
| Example 51 | magnetic toner 51 | B(1.44) | B(1.41) | A | B |

TABLE 7-continued

| | | evaluation 1 (initial density) | evaluation 2 (after 4000 prints) | evaluation 3 (cold offset at normal temperature and normal humidity) | evaluation 4 (cold offset at low temperature and low humidity) |
|---|---|---|---|---|---|
| Example 52 | magnetic toner 52 | B(1.43) | C(1.36) | A | B |
| Example 53 | magnetic toner 53 | A(1.50) | A(1.46) | B | C |
| Example 54 | magnetic toner 54 | B(1.45) | B(1.41) | C | C |
| Comparative Example 1 | comparative magnetic toner 1 | D(1.30) | D(1.15) | C | D |
| Comparative Example 2 | comparative magnetic toner 2 | C(1.38) | D(1.25) | C | D |
| Comparative Example 3 | comparative magnetic toner 3 | C(1.37) | D(1.20) | D | D |
| Comparative Example 4 | comparative magnetic toner 4 | C(1.38) | D(1.24) | D | D |
| Comparative Example 5 | comparative magnetic toner 5 | C(1.36) | D(1.29) | C | D |
| Comparative Example 6 | comparative magnetic toner 6 | C(1.37) | D(1.30) | C | D |
| Comparative Example 7 | comparative magnetic toner 7 | C(1.36) | D(1.24) | C | D |
| Comparative Example 8 | comparative magnetic toner 8 | B(1.44) | D(1.30) | C | D |
| Comparative Example 9 | comparative magnetic toner 9 | B(1.45) | C(1.37) | C | D |
| Comparative Example 10 | comparative magnetic toner 10 | B(1.43) | C(1.36) | C | D |
| Comparative Example 11 | comparative magnetic toner 11 | C(1.37) | D(1.29) | C | D |
| Comparative Example 12 | comparative magnetic toner 12 | C(1.38) | D(1.28) | C | D |
| Comparative Example 13 | comparative magnetic toner 13 | B(1.41) | C(1.36) | D | D |
| Comparative Example 14 | comparative magnetic toner 14 | B(1.41) | C(1.36) | C | D |
| Comparative Example 15 | comparative magnetic toner 15 | B(1.41) | C(1.36) | C | D |
| Comparative Example 16 | comparative magnetic toner 16 | C(1.38) | C(1.36) | C | D |
| Comparative Example 17 | comparative magnetic toner 17 | C(1.36) | D(1.29) | C | D |
| Comparative Example 18 | comparative magnetic toner 18 | B(1.41) | C(1.36) | C | D |
| Comparative Example 19 | comparative magnetic toner 19 | A(1.50) | A(1.47) | B | D |
| Comparative Example 20 | comparative magnetic toner 20 | B(1.41) | D(1.30) | B | C |
| Comparative Example 21 | comparative magnetic toner 21 | A(1.48) | B(1.43) | B | D |
| Comparative Example 22 | comparative magnetic toner 22 | A(1.48) | B(1.41) | C | D |
| Comparative Example 23 | comparative magnetic toner 23 | B(1.41) | D(1.33) | C | D |
| Comparative Example 24 | comparative magnetic toner 24 | A(1.50) | A(1.47) | C | D |
| Comparative Example 25 | comparative magnetic toner 25 | A(1.48) | B(1.43) | B | D |
| Comparative Example 26 | comparative magnetic toner 26 | B(1.43) | C(1.36) | B | D |
| Comparative Example 27 | comparative magnetic toner 27 | A(1.52) | A(1.49) | C | D |
| Comparative Example 28 | comparative magnetic toner 28 | B(1.43) | D(1.29) | B | D |
| Comparative Example 29 | comparative magnetic toner 29 | B(1.41) | D(1.24) | C | D |
| Comparative Example 30 | comparative magnetic toner 30 | B(1.45) | B(1.41) | C | D |
| Comparative Example 31 | comparative magnetic toner 31 | B(1.41) | D(1.25) | C | D |
| Comparative Example 32 | comparative magnetic toner 32 | B(1.43) | B(1.41) | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-286062, filed Dec. 27, 2011, which is hereby incorporated by reference herein in its entirety.

REFERENCE SIGNS LIST

1: main casing
2: rotating member
3, 3*a*, 3*b*: stirring member
4: jacket
5: raw material inlet port
6: product discharge port
7: center shaft
8: drive member
9: processing space
10: end surface of the rotating member
11: direction of rotation
12: back direction
13: forward direction
16: raw material inlet port inner piece
17: product discharge port inner piece
d: distance showing the overlapping portion of the stirring members
D: stirring member width
100: electrostatic latent image-bearing member (photosensitive member)
102: toner-carrying member
103: developing blade
114: transfer member (transfer charging roller)
116: cleaner container
117: charging member (charging roller)
121: laser generator (latent image-forming means, photoexposure apparatus)
123: laser
124: pick-up roller
125: transport belt
126: fixing unit
140: developing device
141: stirring member

The invention claimed is:

1. A magnetic toner comprising:

magnetic toner particles comprising a binder resin and a magnetic body; and inorganic fine particles present on the surface of the magnetic toner particles, wherein;

the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of from at least 0.50 to not more than 0.85, and the binder resin is a styrene resin;

for a weight-average molecular weight (Mw) and an radius of gyration (Rw) measured on the ortho-dichlorobenzene-soluble matter from the magnetic toner in use of size exclusion chromatograph with a multiangle laser light scattering (SEC-MALLS), the weight-average molecular weight (Mw) is from at least 5000 to not more than 20000 and the ratio [Rw/Mw] of this radius of gyration (Rw) to the weight-average molecular weight (Mw) is from at least $3.0\times10^{-3}$ to not more than $6.5\times10^{-3}$; and the viscosity of the magnetic toner at 110° C. measured by a flow tester/temperature ramp-up method is from at least 5000 Pa·s to not more than 25000 Pa·s.

2. The magnetic toner according to claim 1, wherein the weight-average molecular weight (Mw) is from at least 5000 to not more than 20000 and the ratio [Rw/Mw] of the radius of gyration (Rw) to the weight-average molecular weight (Mw) is from at least $5.0\times10^{-3}$ to not more than $6.5\times10^{-3}$.

3. The magnetic toner according to claim 1, wherein the coefficient of variation on the coverage ratio A is not more than 10.0%.

4. The magnetic toner according to claim 1, wherein the magnetic toner particle additionally contains a release agent and this release agent is a hydrocarbon wax.

* * * * *